US010950183B2

(12) United States Patent
Ueno et al.

(10) Patent No.: US 10,950,183 B2
(45) Date of Patent: Mar. 16, 2021

(54) DISPLAY DEVICE AND DRIVING METHOD THEREOF

(71) Applicant: Sharp Kabushiki Kaisha, Sakai (JP)

(72) Inventors: Tetsuya Ueno, Sakai (JP); Asahi Yamato, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/493,367

(22) PCT Filed: Mar. 24, 2017

(86) PCT No.: PCT/JP2017/012122
§ 371 (c)(1),
(2) Date: Sep. 12, 2019

(87) PCT Pub. No.: WO2018/173280
PCT Pub. Date: Sep. 27, 2018

(65) Prior Publication Data

US 2020/0035168 A1 Jan. 30, 2020

(51) Int. Cl.
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2310/0297* (2013.01); *G09G 2310/061* (2013.01)

(58) Field of Classification Search
CPC ..... G09G 2310/061; G09G 2310/0297; G09G 3/3233; G09G 2300/0861
See application file for complete search history.

(56) References Cited

U.S. PATENT DOCUMENTS 8,299,990 B2 * 10/2012 Park ..... G09G 3/2007 345/214
9,754,537 B2 * 9/2017 Lee ..... G09G 3/3208
(Continued)

FOREIGN PATENT DOCUMENTS

JP 2003-140626 A 5/2003
JP 2003-157051 A 5/2003
(Continued)

OTHER PUBLICATIONS

Official Communication issued in International Patent Application No. PCT/JP2017/012122, dated Jun. 20, 2017.
(Continued)

*Primary Examiner* — Priyank J Shah
(74) *Attorney, Agent, or Firm* — Keating & Bennett, LLP

(57) ABSTRACT

The present application discloses an organic EL display device adopting the SSD method, which enables sufficient charging with a data voltage and sufficient internal compensation in a pixel circuit even in a case that a display image has a higher resolution. There are provided m demultiplexers corresponding to m sets of data signal line groups, each of which is a set including k data signal lines (in this case, k=3). Each demultiplexer turns selection control signals to a low level (active) during a rest period before a scanning signal line is selected. In this case, a white voltage is supplied as a reset voltage from a data-side drive circuit to each data signal line via each demultiplexer. After that, each demultiplexer sequentially turns the selection control signals to an active state for a predetermined period such that the select control signal turns to the active state during the select period for the scanning signal line. With this, the data signals are sequentially supplied from the data-side drive circuit to the k data signal lines.

6 Claims, 15 Drawing Sheets

(56) References Cited

U.S. PATENT DOCUMENTS

| | | | | |
|---|---|---|---|---|
| 2003/0043132 | A1 | 3/2003 | Nakamura | |
| 2003/0085885 | A1* | 5/2003 | Nakayoshi | G09G 3/3225 345/205 |
| 2007/0118781 | A1 | 5/2007 | Kim | |
| 2007/0242016 | A1* | 10/2007 | Choi | G09G 3/3233 345/92 |
| 2008/0150844 | A1 | 6/2008 | Choi | |
| 2011/0025678 | A1* | 2/2011 | Chung | G09G 3/3233 345/213 |
| 2014/0152639 | A1* | 6/2014 | Bang | G09G 3/3233 345/212 |
| 2014/0198135 | A1* | 7/2014 | Eom | G09G 3/3275 345/690 |
| 2017/0053601 | A1* | 2/2017 | Lee | G09G 3/3258 |
| 2017/0069235 | A1* | 3/2017 | Lee | G09G 3/3291 |
| 2020/0035169 | A1* | 1/2020 | Sakai | G09G 3/3233 |

FOREIGN PATENT DOCUMENTS

| | | | |
|---|---|---|---|
| JP | 2007-079580 | A | 3/2007 |
| JP | 2007-286572 | A | 11/2007 |
| JP | 2008-158475 | A | 7/2008 |
| JP | 2010-002736 | A | 1/2010 |
| JP | 2013-190526 | A | 9/2013 |

OTHER PUBLICATIONS

Yokoyama et al., "Display Device and Driving Method Therefor,", U.S. Appl. No. 16/493,369, filed Sep. 12, 2019.

* cited by examiner

DISPLAY DEVICE AND DRIVING METHOD THEREOF

TECHNICAL FIELD

The disclosure relates to a display device, more specifically, to a display device including a display element driven by a current such as an organic Electro Luminescence (EL) display device, and a driving method of the display device.

BACKGROUND ART

An organic EL display device has been known as a thin-type, high picture quality, and low power consumption display device. In the organic EL display device, a plurality of pixel circuits including organic EL elements that are self-luminous type display elements driven by currents, drive transistors, and the like, are arranged in a matrix.

As one of the driving methods of various display devices such as an organic EL display device, a driving method in which driving signals generated by a data-side drive circuit (hereinafter, also referred to as a "data driver") are demultiplexed and supplied to the predetermined number, that is two or more, of data lines (source line) (hereinafter, referred to as a "source shared driving (SSD) method") in a display unit has been known. FIG. 12 is a circuit diagram illustrating a connection relationship between pixel circuits and various wiring lines in an organic EL display device adopting the SSD method disclosed in PTL 1 (hereinafter, referred to as a "first known example"). The organic EL display device adopting the SSD method performs color display of RGB three-primary colors. There are provided m×k×n pixel circuits 11 corresponding to intersections between m×k data lines (each of m and k is an integer equal to or more than 2) and n scanning lines (n is an integer equal to or more than 2). In the present specification, a pixel circuit corresponding to "R" (red) is referred to as an "R pixel circuit," and is denoted by the reference symbol "11*r*." Further, a pixel circuit corresponding to "G" (green) is referred to as a "G pixel circuit," and is denoted by the reference symbol "11*g*." Further, a pixel circuit corresponding to "B" (blue) is referred to as a "B pixel circuit," and is denoted by the reference symbol "11*b*."

Respective m output lines Di (i=1 to m) connected to output terminals of a data driver (not illustrated) correspond to m demultiplexers 41. Each output line Di corresponding to each demultiplexer 41 is connected to three data lines Dr1, Dgi, and Dbi with three selecting transistors Mr, Mg, and Mb interposed therebetween, respectively, included in the demultiplexer 41. Each of the selecting transistors Mr, Mg, and Mb is a P-channel type transistor that functions as a switching element. The selecting transistors Mr, Mg, and Mb correspond to R, G, and B, respectively. The selecting transistor Mr turns to an on state in response to a selection control signal SSDr in a case that a data signal corresponding to R (hereinafter, referred to as an "R data signal") is to be supplied to the data line Dri. The selecting transistor Mg turns to an on state in response to a selection control signal SSDg in a case that a data signal corresponding to G (hereinafter, referred to as a "G data signal") is to be supplied to the data line Dgi. The selecting transistor Mb turns to an on state in response to a selection control signal SSDb in a case that a data signal corresponding to B (hereinafter, referred to as a "B data signal") is to be supplied to the data line Dbi. Hereinafter, the selecting transistors Mr, Mg, and Mb are referred to as an "R selecting transistor," a "G selecting transistor," and a "B selecting transistor," respectively. Further, the selection control signals SSDr, SSDg, and SSDb are referred to as an "R selection control signal," a "G selection control signal," and a "B selection control signal," respectively. Further, the data lines Dri, Dgi, and Dbi are referred to as an "R data line," a "G data line," and a "B data line," respectively. The data signal output from the data driver is divided in time division by the respective demultiplexers 41, and is supplied to the R data line Dri, the G data line Dgi, and the B data line Dbi in the stated order, which are connected to the demultiplexers 41. Adopting the SSD method like this can reduce a circuitry scale of the data driver.

In the first known example (the organic EL display device disclosed in PTL 1), as illustrated in FIG. 12, data capacitors Cdri, Cdgi, and Cdbi for holding a voltage of the data signal (hereinafter, also referred to as a "data voltage") are connected to the R data line Dri, the G data line Dgi, and the B data line Dbi, respectively. Hereinafter, the data capacitors Cdri, Cdgi, and Cdbi are referred to as an "R data capacitor," a "G data capacitor," and a "B data capacitor," respectively. Each pixel circuit 11 includes one organic EL element OLED, six transistors M1 to M6, and two capacitors C1 and C2. The transistors M1 to M6 all are P-channel type transistors. The transistor M1 is a drive transistor for controlling a current to be supplied to the organic EL element OLED. The transistor M2 is a writing transistor for writing a voltage of a data signal (data voltage) into the pixel circuit. The transistor M3 is a compensating transistor for compensating variation in a threshold voltage of the drive transistor M1 which causes a luminance unevenness. The transistor M4 is an initialization transistor for initializing a gate voltage Vg of the drive transistor M1. The transistor M5 is a power-supplying transistor for controlling the supply of the high-level power source voltage ELVDD to the pixel circuit 11. The transistor M6 is a light emission control transistor for controlling a light emission period of the organic EL element OLED. The capacitors C1 and C2 are capacitors for holding a source-gate voltage Vgs of the drive transistor M1. In each of the R pixel circuit 11*r*, the G pixel circuit 11*g*, and the B pixel circuit 11*b*, the gate terminal of the writing transistor M2 is connected to a scanning line Sj along each of the R pixel circuit 11*r*, the G pixel circuit 11*g*, and the B pixel circuit 11*b*.

FIG. 13 is a timing chart illustrating a driving method of the pixel circuit illustrated in FIG. 12. From a time t1 to a time t2, the initialization transistor M4 is in the on state so that the gate voltage Vg of the drive transistor M1 is initialized. From the time t2 to a time t3, an R data signal is supplied to the R data line Dri, and a voltage of the R data signal is held in the R data capacitor Cdri. From the time t3 to a time t4, a G data signal is supplied to the G data line Dgi, and a voltage of the G data signal is held in the G data capacitor Cdgi. From the time t4 to a time t5, a B data signal is supplied to the B data line Dbi, and a voltage of the B data signal is held in the B data capacitor Cdbi. At the time t5, in each of the R pixel circuit 11*r*, the G pixel circuit 11*g*, and the B pixel circuit 11*b*, the writing transistor M2 and the compensating transistor M3 turns to the on state so that the data voltage is supplied to the gate terminal of the drive transistor M1 via the writing transistor M2, the drive transistor M1, and the compensating transistor M3. At this time, the drive transistor M1 turns to a diode-connected state, and the gate voltage Vg of the drive transistor M1 is obtained by Equation (1) below.

$$Vg = Vdata - Vth \quad (1)$$

where Vdata is the data voltage, and Vth is the threshold voltage of the drive transistor M1.

At a time t6, the writing transistor M2 and the compensating transistor M3 turn to an off state, and the power-supplying transistor M5 and the light emission control transistor M6 turn to the on state. For this reason, a drive current I expressed by Equation (2) below is supplied to the organic EL element OLED so that the organic EL element OLED emits light according to a current value of the drive current I.

$$I=((\beta/2)\cdot(Vgs-Vth)^2 \quad (2)$$

where, β represents a constant, and Vgs represents a source-gate voltage of the drive transistor M1. The source-gate voltage Vgs of the drive transistor M1 is obtained by Equation (3) below.

$$Vgs=ELVDD-Vg\ldots=ELVDD-Vdata+Vth \quad (3)$$

Equation (4) below is derived from Equation (2) and Equation (3).

$$I=(\beta/2\cdot(ELVDD-Vdata)^2 \quad (4)$$

In Equation (4), a term of the threshold voltage Vth is absent. For this reason, the variation in the threshold voltage Vth of the drive transistor M1 is compensated. In this way, in the first known example, the variation in the threshold voltage of the drive transistor is compensated by a configuration in the pixel circuit (hereinafter, the compensation of the threshold voltage of the drive transistor in the above-mentioned manner is referred to as an "internal compensation"). Note that, it has been known that the longer a period Tcomp is set during which the threshold voltage Vth is compensated by putting the drive transistor M1 into the diode-connected state, the more the variation in the threshold voltage Vth of the drive transistor M1 is suppressed.

CITATION LIST

Patent Literature

PTL 1: JP 2007-79580 A
PTL 2: JP 2008-158475 A
PTL 3: JP 2007-286572 A

SUMMARY

Technical Problem

In the first known example (the organic EL display device disclosed in PTL 1) described above, the R data signal, the G data signal, and the B data signal are sequentially supplied to the R data line Dri, the G data line Dgi, and the B data line Dbi, respectively. Further, as illustrated in FIG. 12, a connection destination of the gate terminal of the writing transistor M2 is the scanning line Sj in any of the R pixel circuit 11*r*, the G pixel circuit 11*g*, and the B pixel circuit 11*b*. For this reason, when the scanning line Sj is in a select state before starting any of the supply of the R data signal to the R data line Dri, the supply of the G data signal to the G data line Dgi, and the supply of the B data signal to the B data line Dbi, any of the voltage supplied from the R data line Dri, the G data line Dgi, and the B data line Dbi may not be able to be written into the capacitor C1.

For example, as illustrated in FIG. 14, when the scanning line Sj is in the select state (the scanning signal is turned to the low level) before starting the supply of the R data signal to the R data line Dri, a voltage of the R data signal (hereinafter, referred to as the "R data voltage in last scanning") which is supplied to the R data line Dri when a previous scanning line Sj-1 is selected is written into the capacitor C1 via the drive transistor M1. As is seen from FIG. 12, when the scanning line Sj is in the select state, the R data line Dri is electrically connected to the capacitor C1 with the drive transistor M1 in the diode-connected state interposed therebetween. For this reason, in a case where the voltage of the R data signal (hereinafter, referred to as the "R data voltage in present scanning") which is supplied to the R data line Dr when the scanning line Sj is in the select state is lower than the R data voltage in last scanning, the R data voltage in present scanning cannot be written into the capacitor C1. For example, in a case where the R data voltage in last scanning is a voltage corresponding to a luminance closer to a minimum luminance (black display), the voltage corresponding to a luminance closer to the minimum luminance, that is, a voltage closer to a maximum value is written into the capacitor C1 in the R pixel circuit 11*r* from when the scanning line Sj is selected to when the selecting transistor Mr in the demultiplexer 41 is turned on (from when a signal of the scanning line Sj changes to the low level to when the selection control signal SSDr changes to the low level) as illustrated in FIG. 14. For this reason, when a voltage corresponding to a relatively high luminance, that is, a voltage Vd2 sufficiently less than a maximum value Vd1 is applied as the R data voltage in present scanning to the R pixel circuit 11*r*, the drive transistor M1 in the R pixel circuit 11*r* turns to the off state, and a voltage of the capacitor C1 thereof (the gate voltage Vg of the gate terminal of the drive transistor M1) is maintained as a voltage Vng2 at a voltage closer to the maximum value.

To avoid such a problem (hereinafter, referred to as a "a data writing failure caused by such a diode-connection"), the first known example described above is configured such that, as illustrated in FIG. 13, the scanning line Sj is in a non-select state during a data write period during which the R, G, and B data signals are supplied to the R, G, and B data lines Drj, Dgj, and Dbj, respectively, and after the data write period elapses, the scanning line Sj turns to the select state (the low level in the example in FIG. 13).

In this way, in the first known example described above, the R, G, and B data signals are written into the R, G, and B pixel circuits, respectively, by turning the scanning line Sj to the select state after the R, G, and B data signals are sequentially written into the R, G, and B data lines Drj, Dgj, and Dbj on the basis of the SSD method. Specifically, in the organic EL display device using the SSD method in which the diode-connection is used to perform internal compensation as in the first known example, gray scale data (data voltage) indicated by those data signals cannot be written into the pixel circuits unless sequential writing of the data signals into a data signal line group such a set of R, G, and B data lines Drj, Dgj, and Dbj is completed. For this reason, the writing of the gray scale data into the pixel circuit, that is, the charging of the data voltage to the data-holding capacitor C1 in the pixel circuit may not be performed sufficiently. In a case where a horizontal interval is shortened with improvement in high resolution of a display image in recent years, a period for writing the data into the data signal line and a select period of the scanning line in the horizontal interval are also shortened, and therefore, such charge shortage is particularly problematic. In a case that the select period of the scanning line is shortened, the luminance unevenness also cannot be sufficiently suppressed by compensating the variation in the threshold voltage of the drive transistor in each pixel circuit.

With regard to this point, an organic EL display device described in, for example, PTL 2 (an organic electroluminescence display device) (hereinafter, referred to as a "second known example") is configured to perform internal compensation while adopting the SSD method similarly to the first known example illustrated in FIG. 12, and a drive method as illustrated in FIG. 15 is used. This driving method involves, at a data programing stage, a data line initialization stage Sdi in which the data lines are initialized by lowering the voltages of the data lines Dri, Dgi, and Dbi. Specifically, with the circuit configuration illustrated in FIG. 12 as a premise, as illustrated in FIG. 15, the data line initialization stage Sdi is started at a time is after data signals Rdn, Gdn, and Bdn are supplied to the pixel circuits 11*r*, 11*g*, and 11*b* via the data lines Dri, Dgi, and Dbi, respectively, by sequentially turning the selecting transistors (switching elements) Mr, Mg, and Mb of the demultiplexer 41 to the on state in response to the selection control signals SSDr, SSDg, and SSDb. With this driving method, the data lines Dri, Dgi, and Dbi are initialized by initialization data signals Ri, Gi, and Bi, respectively, before the selecting transistors Mr, Mg, and Mb are turned off during the select period of the last scanning line Sj−1 before the select period of the present scanning line Sj (the low-level period in FIG. 15) during which data signals Rdn, Gdn, and Bdn are supplied to the data lines Dri, Dgi, and Dbi, respectively.

In the second known example described above, while avoiding the problem illustrated in FIG. 14, that is, the data writing failure caused by such a diode-connection, the period during which writing of the data voltage into the pixel circuit and compensation of the threshold voltage Vth of the drive transistor are performed can be increased as compared the first known example described above (see FIG. 13 and FIG. 15). However, as illustrated in FIG. 15, the three data line initialization stages Sdi are included in each horizontal period (1H period) during which the scanning line is in the select state. Thus, in a case that a display image has a higher resolution, even the second known example described above cannot sufficiently solve problems such as insufficient charge of the data voltage and insufficient time for the internal compensation in the pixel circuit.

Therefore, it has been desired to provide an organic EL display device adopting the SSD method, which enables sufficient charging of a data voltage and sufficient internal compensation in a pixel circuit even in a case that a display image has a higher resolution.

Solution to Problem

According to embodiments of the disclosure, a display device includes a plurality of data signal lines configured to transmit a plurality of analog voltage signals indicating an image to be displayed, a plurality of scanning signal lines intersecting the plurality of data signal lines, and a plurality of pixel circuits arranged in a matrix shape along the plurality of data signal lines and the plurality of scanning signal lines. The display device further includes a data-side drive circuit including a plurality of output terminals corresponding to a plurality sets of data signal line groups that are obtained by dividing the plurality of data signal lines into groups, each of which is a set including a two or more predetermined number of data signal lines and configured to output, in time division from each of the plurality of output terminals, a predetermined number of analog voltage signals to be transmitted by the predetermined number of data signal lines of a set corresponding to each of the plurality of output terminals, a plurality of demultiplexers respectively connected to the plurality of output terminals of the data-side drive circuit and respectively correspond to the plurality sets of data signal line groups, a scanning-side drive circuit configured to selectively drive the plurality of scanning signal lines, and a display control circuit configured to control the plurality of demultiplexers, the data-side drive circuit, and the scanning-side drive circuit. Each of the plurality of demultiplexers includes a predetermined number of switching elements corresponding respectively to the predetermined number of data signal lines in a corresponding set, and each of the predetermined number of switching elements includes a first conduction terminal connected to a corresponding data signal line, a second conduction terminal configured to receive an analog voltage signal output by the data-side drive circuit from an output terminal of the plurality of output terminals connected to a demultiplexer of the plurality of demultiplexers, and a control terminal configured to receive a selection control signal for controlling on and off states. Each of the plurality of pixel circuits corresponds to any one of the plurality of data signal lines and corresponds to any one of the plurality of scanning signal lines. Each of the plurality of pixel circuits includes a display element configured to be driven by a current, a holding capacitance configured to hold a voltage for controlling a drive current for the display element, and a drive transistor configured to supply, to the display element, the drive current in accordance with the voltage held in the holding capacitance and is configured such that in a case that a corresponding scanning signal line is in a select state, the drive transistor is in a diode-connected state, and a voltage of a corresponding data signal line is supplied to the holding capacitance via the drive transistor. The display control circuit turns one or more switching elements to an on state among the predetermined number of switching elements in each of the plurality of demultiplexers during a reset period provided, for a scanning signal line of the plurality of scanning signal lines, after a preceding scanning signal line is changed to a non-select state and before the scanning signal line is selected, the preceding scanning signal line being another scanning signal line of the plurality of scanning signal lines selected immediately before the scanning signal line is selected and sequentially turns the predetermined number of switching elements to the on state for a predetermined period after the reset period and before the scanning signal line is changed from the select state to the non-select state such that at least one switching element of the one or more switching elements turns to the on state during a select period for each of the plurality of scanning signal lines. The data-side drive circuit, during the reset period, outputs a voltage for initializing each of the plurality of data signal lines as a reset voltage from each of the plurality of output terminals and, after the reset period, outputs the predetermined number of analog voltage signals in time division from each of the plurality of output terminals in accordance with control of the display control circuit that sequentially turns the predetermined number of switching elements to the on state for the predetermined period.

A driving method according to embodiments of the disclosure is a driving method of a display device including a plurality of data signal lines configured to transmit a plurality of analog voltage signals indicating an image to be displayed, a plurality of scanning signal lines intersecting the plurality of data signal lines, and a plurality of pixel circuits arranged in a matrix shape along the plurality of data signal lines and the plurality of scanning signal lines. The display device further includes a data-side drive circuit including a plurality of output terminals respectively corresponding to a plurality sets of data signal line groups that are obtained by dividing the plurality of data signal lines into groups, each of which is a set including a two or more predetermined number of data signal lines, and a plurality of demultiplexers respectively connected to the plurality of output terminals of the data-side drive circuit and corresponding to the plurality sets of data signal line groups, respectively. Each of the plurality of demultiplexers includes a predetermined number of switching elements corresponding to the predetermined number of data signal lines in a corresponding set, respectively. Each of the predetermined number of switching elements includes a first conduction terminal connected to a corresponding data signal line, a second conduction terminal configured to receive an analog voltage signal output by the data-side drive circuit from an output terminal of the plurality of output terminals connected to a demultiplexer of the plurality of demultiplexers, and a control terminal configured to receive a selection control signal for controlling on and off states. Each of the plurality of pixel circuits corresponds to any one of the plurality of data signal lines and corresponds to any one of the plurality of scanning signal lines. Each of the plurality of pixel circuits includes a display element configured to be driven by a current, a holding capacitance configured to hold a voltage for controlling a drive current for the display element, and a drive transistor configured to supply, to the display element, the drive current in accordance with the voltage held in the holding capacitance and is configured such that in a case that a corresponding scanning signal line is in a select state, the drive transistor is in a diode-connected state, and the voltage is supplied from a corresponding data signal line to the holding capacitance via the drive transistor. The method includes a scanning-side driving step of selectively driving the plurality of scanning signal lines, a reset step of turning one or more switching elements to an on state among the predetermined number of switching elements in each of the plurality of demultiplexers during a reset period provided, for a scanning signal line of the plurality of scanning signal lines, after a preceding scanning signal line is changed to a non-select state and before the scanning signal line is selected, the preceding scanning signal line being another scanning signal line of the plurality of scanning signal lines selected immediately before the scanning signal line is selected, a demultiplex step of sequentially turning the predetermined number of switching elements to the on state for a predetermined period after the reset period and before the scanning signal line is changed from the select state to the non-select state such that at least one switching element of the one or more switching elements turns to the on state during a select period for each of the plurality of scanning signal lines, a reset voltage output step of outputting a voltage for initializing each of the plurality of data signal lines as a reset voltage from each of the plurality of output terminals of the data-side driver circuit during the reset period, and a data signal output step of outputting, in time division from each of the plurality of output terminals of the data-side drive circuit, the predetermined number of analog voltage signals to be each transmitted to the predetermined number of data signal lines in the set corresponding to each of the plurality of output terminals after the reset period, in accordance with the demultiplex step of sequentially turning the predetermined number of switching elements to the on state for the predetermined period.

Advantageous Effects of Disclosure

In the embodiments of the disclosure, the SSD method is adopted. For a scanning signal line of the plurality of scanning signal lines, one or more switching elements among the predetermined number of switching elements in each demultiplexer turn to an on state during the reset period provided after the preceding scanning signal line, which is selected immediately before the scanning signal line is selected, is changed to the non-select state and before the scanning signal line is selected. With this, the reset voltage is supplied to the data signal lines connected to the one or more switching elements via each demultiplexer during the reset period. After that, the predetermined number of switching elements in each demultiplexer sequentially turn to the on state for the predetermined period after the reset period and before the scanning signal line is changed from the select state to the non-select state such that at least one switching element among the one or more switching elements is in the on state during the select period for each scanning signal line. With this, the predetermined number of analog voltage signals, which are output in time division from each output terminal of the data-side drive circuit, are sequentially supplied to the predetermined number of corresponding data signal lines via the corresponding demultiplexer. As described above, according to the embodiments of the disclosure, the data signal line, which is connected to the switching element in the on state during the select period for each scanning signal line, is initialized during the reset period before the select period. Thus, while avoiding the data writing failure caused by the diode-connection in the pixel circuit, the period during which the data signal line is charged with the analog voltage signal as a data signal and the period during which the holding capacitance in the pixel circuit is charged with the voltage of the data signal line (scanning select period) can overlap with each other. With this, the charging period of each data signal line and the charging period of the holding capacitance in the pixel circuit corresponding thereto can be increased. With this, sufficient charging of the data voltage and sufficient internal compensation in the pixel circuit can be performed even in a case that a display image has a higher resolution.

DESCRIPTION OF EMBODIMENTS

In the following, each embodiment is described with reference to the accompanying drawings. Note that, in each of the transistors referred to below, the gate terminal corresponds to a control terminal, one of the drain terminal and the source terminal corresponds to a first conduction terminal, and the other corresponds to a second conduction terminal. Further, each of the transistors in each embodiment is described as a P-channel type transistor, but the disclosure is not limited thereto. Furthermore, the transistor in each embodiment is, for example, a thin film transistor, but the disclosure is not limited thereto. Still further, the term "connection" used herein means "electrical connection" unless otherwise specified, and without departing from the gist and scope of the disclosure, the term includes not only a case in which direct connection is meant but also a case in which indirect connection with another element therebetween is meant.

1. First Embodiment

1.1 Overall Configuration

Figure 1:
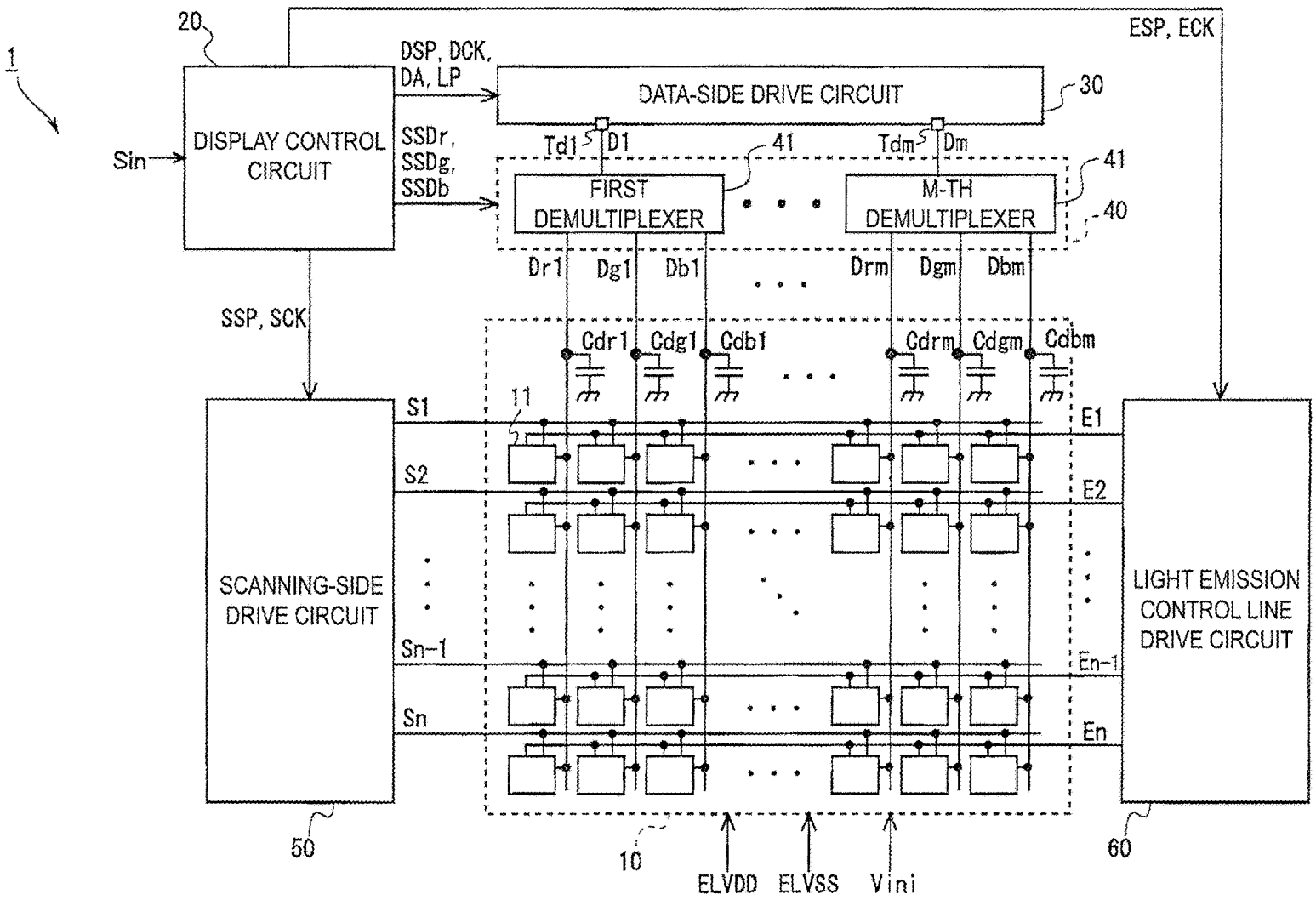
FIG. 1 is a block diagram illustrating an overall configuration of a display device according to a first embodiment.

FIG. 1 is a block diagram illustrating an overall configuration of a display device 1 according to a first embodiment. The display device 1 is an organic EL display device adopting the SSD method for performing internal compensation, and performs color display with three primary colors including red, green, and blue. As illustrated in FIG. 1, the display device 1 includes a display unit 10, a display control circuit 20, a data-side drive circuit (also referred to as a "data driver") 30, a demultiplexer unit 40, a scanning-side drive circuit (also referred to as a "scanning driver") 50, and a light emission control line drive circuit (also referred to as an "emission driver") 60. In the present embodiment, the scanning-side drive circuit 50 and the light emission control line drive circuit 60 are formed so as to be integrated with the display unit 10 (this holds true in the other embodiments and the modified examples). However, the disclosure is not limited thereto.

In the display unit 10, m×k (m and k are integers of 2 or more, and k=3 in the present embodiment) data signal lines Dr1, Dg1, Db1, Dr2, Dg2, Db2, Drm, Dgm, and Dbm and n scanning signal lines S1 to Sn intersecting these data signal lines are disposed, and n light emission control lines (also referred to as "emission lines") E1 to En are respectively disposed along the n scanning signal lines S1 to Sn. Further, as illustrated in FIG. 1, the display unit 10 is provided with the 3m×n pixel circuits 11, and those 3m×n pixel circuits 11 are arranged in a matrix shape along the m×k (=3m) data signal lines Dx1 to Dxm (x=r, g, b) and the n scanning signal lines S1 to Sn in such a manner that each of these 3m×n pixel circuits 11 corresponds to any one of the 3m data signal lines Dx1 to Dxm (x=r, g, b), corresponds to any one of the n scanning signal lines S1 to Sn, and corresponds to any one of the n light emission control lines E1 to En. The 3m data signal lines Dx1 to Dxm (x=r, g, b) are connected to the demultiplexer unit 40, the n scanning signal lines S1 to Sn are connected to the scanning-side drive circuit 50, and the n light emission control lines E1 to En are connected to the light emission control line drive circuit 60.

In addition, in the display unit 10, a power source line common to each pixel circuit 11 (not illustrated) is provided. To be more specific, disposed are a power source line (hereinafter, referred to as a "high-level power source line", and designated by a reference sign "ELVDD" similarly to the high-level power supply voltage) for supplying the high-level power supply voltage ELVDD for driving the organic EL element described later and a power source line (hereinafter, referred to as a "low-level power source line", and designated by a reference sign "ELVSS" similarly to the low-level power supply voltage) for supplying the low-level power supply voltage ELVSS for driving the organic EL element. Further, disposed is an initialization line (designated by a reference sign "Vini" similarly to the initialization voltage) for supplying the initialization voltage Vini for an initialization action described later. These voltages are supplied from a power source circuit (not illustrated).

In FIG. 1, each of the wiring line capacitances Cdr1 to Cdrm formed at the m data signal lines Dr1 to Drm (hereinafter, also referred to as "R data signal lines Dr1 to Drm") is illustrated as a capacitor, each of the wiring line capacitances Cdg1 to Cdgm formed at the m data signal lines Dg1 to Dgm (hereinafter, also referred to as "G data signal lines Dg1 to Dgm") is illustrated as a capacitor, and each of the wiring line capacitances Cdb1 to Cdbm formed at the m data signal lines Db1 to Dbm (hereinafter, also referred to as "B data signal lines Db1 to Dbm") is illustrated as a capacitor (hereinafter, those wiring line capacitances Cdxi (x=r, g, b; i=1 to m) are referred to as "data line capacitances"). A ground voltage is applied to one end (on a side not connected to the data signal line Dxi) of each data line capacitance Cdxi, but the disclosure is not limited thereto.

The display control circuit 20 receives an input signal Sin including image information representing an image to be displayed and timing control information for image display from the outside of the display device 1, and on the basis of the input signal Sin, outputs various control signals to the data-side drive circuit 30, the demultiplexer unit 40, the scanning-side drive circuit 50, and the light emission control line drive circuit 60. More specifically, the display control circuit 20 outputs a data start pulse DSP, a data clock signal DCK, display data DA, and a latch pulse LP to the data-side drive circuit 30. The display control circuit 20 also outputs an R selection control signal SSDr, a G selection control signal SSDg, a B selection control signal SSDb to the demultiplexer unit 40. Furthermore, the display control circuit 20 outputs a scan start pulse SSP and a scan clock signal SCK to the scanning-side drive circuit 50. Furthermore, the display control circuit 20 outputs a light emission control start pulse ESP and a light emission control clock signal ECK to the light emission control line drive circuit 60.

The data-side drive circuit 30 includes an m-bit shift register, a sampling circuit, a latch circuit, m D/A converters, and the like, which are not illustrated. The shift register includes m bistable circuits cascade-connected with each other, transfers the data start pulse DSP supplied in the initial stage in synchronization with the data clock signal DCK, and outputs sampling pulses from each stage. In accordance with the output timing of the sampling pulses, the display data DA is supplied to the sampling circuit. The sampling circuit stores the display data DA in accordance with the sampling pulses. In a case that one line of the display data DA is stored in the sampling circuit, the display control circuit 20 outputs the latch pulse LP to the latch circuit. The latch circuit, when having received the latch pulse LP, retains the display data DA stored in the sampling circuit. The D/A converters are provided correspondingly to the m output lines D1 to Dm respectively connected to m output terminals Td1 to Tdm of the data-side drive circuit 30, convert the display data DA held in the latch circuit into data signals being analog voltage signals, and supply the obtained data signals to the output lines D1 to Dm. The display device 1 according to the present embodiment performs the color display of RGB three-primary colors and adopts the SSD method, and hence the R data signal, the G data signal, and the B data signal are supplied to each output lines Di sequentially (in a time-division manner). Here, the R data signal is a data signal to be applied to the R data signal lines Dr1 to Drm among the 3m data signal lines Dx1 to Dxm (x=r, g, b) in the display unit 10 and indicates a red-color component of an image to be displayed. The G data signal is a data signal to be applied to the G data signal lines Dg1 to Dgm among the 3m data signal lines Dx1 to Dxm and indicates a green-color component of an image to be displayed. The B data signal is a data signal to be applied to the B data signal lines Db1 to Dbm among the 3m data signal lines Dx1 to Dxm and indicates a blue-color component of an image to be displayed.

The demultiplexer unit 40 includes m demultiplexers 41 which are first to m-th demultiplexers 41 respectively corresponding to the m output terminals Td1 to Tdm of the data-side drive circuit 30. The input terminal of the i-th demultiplexer is connected to the corresponding output terminal Tdi of the data-side drive circuit 30 with the output line Di interposed therebetween (i=1 to m). The i-th demultiplexer 41 (i=1 to m) includes three output terminals, and these three output terminals are respectively connected to three data signal lines Dri, Dgi, and Dbi. The i-th demultiplexer 41 supplies the R data signal, the G data signal, and the B data signal sequentially supplied from the output terminal Tdi of the data-side drive circuit 30 via the output line Di respectively to the R data signal line Dri, the G data signal line Dgi, and the B data signal line Dbi. The operation of each demultiplexer 41 is controlled by the R selection control signal SSDr, the G selection control signal SSDg, and the B selection control signal SSDb. With the SSD method, the number of output lines connected to the data-side drive circuit 30 can be reduced to one-third as compared to the case where the SSD method is not adopted. Thus, the circuit scale of the data-side drive circuit 30 is reduced, and hence the manufacturing cost of the data-side drive circuit 30 can be reduced.

The scanning-side drive circuit 50 drives n scanning lines S1 to Sn. More specifically, the scanning-side drive circuit 50 includes a shift register, buffers, and the like (not illustrated). The shift register sequentially transfers the scan start pulse SSP in synchronization with the scan clock signal SCK. The scanning signal being the output from each stage of the shift register is supplied to the corresponding scanning signal line Sj (j=1 to n) via a buffer. The 3m pixel circuits 11 connected to the scanning signal line Sj are collectively selected by the active scanning signals (at the low level scanning signals in the present embodiment).

The light emission control line drive circuit 60 drives n light emission control lines E1 to En. More specifically, the light emission control line drive circuit 60 includes a shift register, buffers, and the like (not illustrated). The shift register sequentially transfers the light emission control start pulse ESP in synchronization with the light emission control clock signal ECK. The light emission control signal being the output from each stage of the shift register is supplied to the corresponding light emission control line Ej (j=1 to n) via a buffer.

As illustrated in FIG. 1, the scanning-side drive circuit 50 is disposed on one end side of the display unit 10 (the left side of the display unit 10 in FIG. 1), and the light emission control line drive circuit 60 is disposed on the other end side of the display unit 10 (the right side of the display unit 10 in FIG. 1). However, in place of the above, both of the scanning-side drive circuit 50 and the light emission control line drive circuit 60 or a scanning-side drive circuit including a function of a light emission control line drive circuit may be disposed on any one of the one end side and the other end side of the display unit 10 (this holds true in the other embodiments and the modified examples).

1.2 Connection Relationship Between Pixel Circuit and Various Wiring Lines

Figure 2:
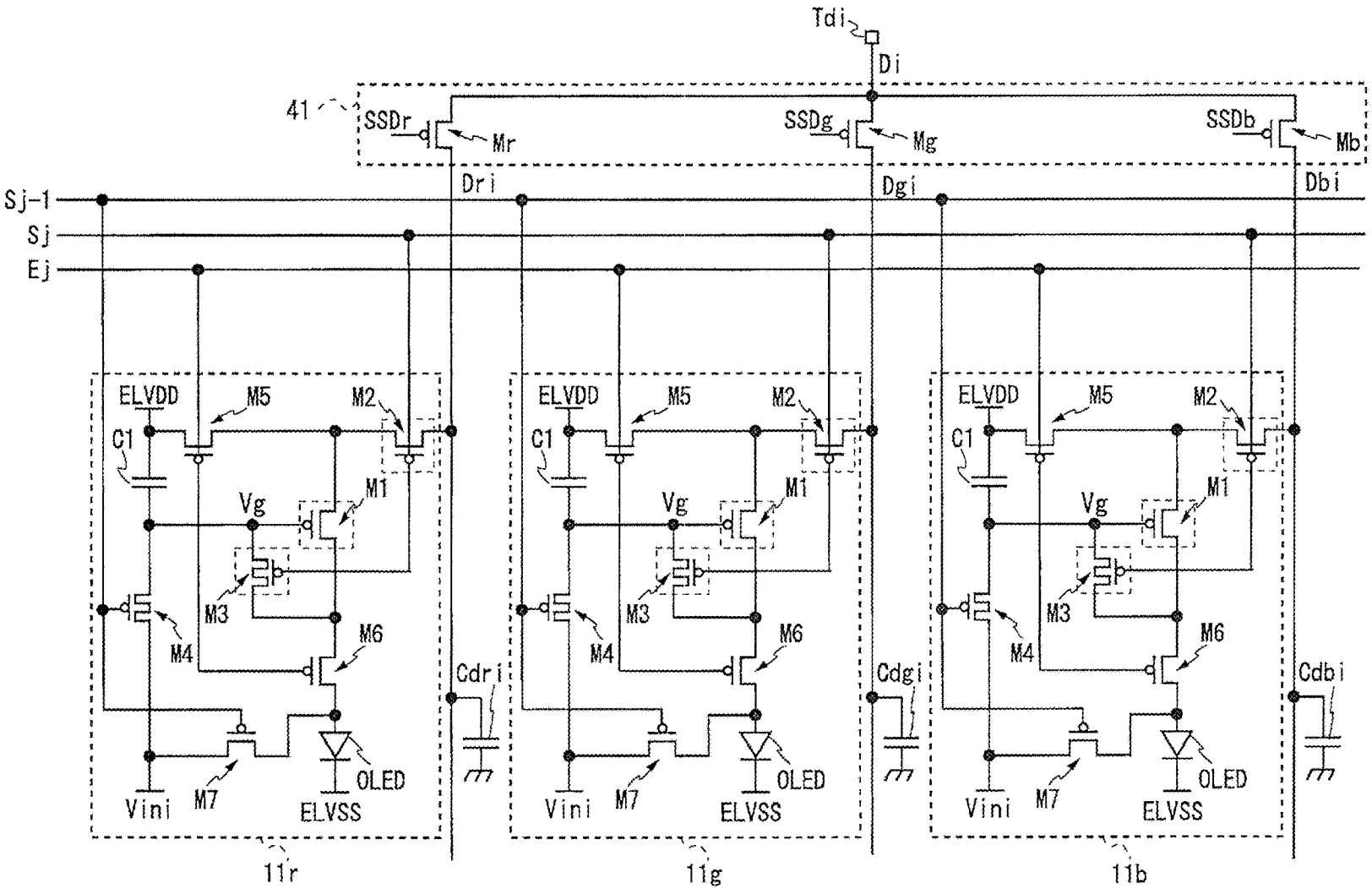
FIG. 2 is a circuit diagram illustrating a connection relationship between pixel circuits and various wiring lines in the first embodiment.

FIG. 2 is a circuit diagram illustrating a connection relationship between a part of pixel circuits 11*r*, 11*g*, and 11*b* and various wiring lines in the present embodiment. Among the 3m×n pixel circuits 11 in the display unit 10, these pixel circuits 11*r*, 11*g*, and 11*b* are connected to the same scanning signal line Sj and are connected to the same demultiplexer 41 with the respective three data signal lines Dri, Dgi, and Dbi interposed therebetween. Here, the reference symbol "11*r*" is used to indicate the pixel circuit 11 connected to the R data signal line Dri (hereinafter, also referred to as an "R pixel circuit"), the reference symbol "11*g*" is used to indicate the pixel circuit 11 connected to the G data signal line Dgi (hereinafter, also referred to as a "G pixel circuit"), and the reference symbol "11*b*" is used to indicate the pixel circuit 11 connected to the B data signal line Dbi (hereinafter, also referred to as a "B pixel circuit").

As illustrated in FIG. 2, each of the demultiplexers 41 includes an R selecting transistor Mr, a G selecting transistor Mg, and a B selecting transistor Mb as switching elements. An R selection control signal SSDr is supplied to the gate terminal as a control terminal of the R selecting transistor Mr, a G selection control signal SSDg is supplied to the gate terminal as a control terminal of the G selecting transistor Mg, and a B selection control signal SSDb is supplied to the gate terminal as a control terminal of the B selecting transistor Mb. Thus, in a case that the R selection control signal SSDr is at a high level (inactive), the R selecting transistor Mr is in the off state. In a case that the R selection control signal SSDr is at a low level (active), the R selecting transistor Mr is in the on state. Further, in a case that the G selection control signal SSDg is at a high level, the G selecting transistor Mg is in the off state. In a case that the G selection control signal SSDg is at a low level, the G selecting transistor Mg is in the on state. Further, in a case that the B selection control signal SSDb is at a high level, the B selecting transistor Mb is in the off state. In a case that the B selection control signal SSDb is at a low level, the B selecting transistor Mb is in the on state. The drain terminals as first conduction terminals of these selecting transistors Mr, Mg, and Mb are respectively connected to the data signal lines Dri, Dgi, and Dbi, and all of the source terminals as second conduction terminals of these selecting transistors Mr, Mg, and Mb are connected to the output line Di (i=1 to m). Therefore, each output line Di is connected to the R data signal line Dri with the R selecting transistor Mr interposed therebetween, to the G data signal line Dgi with the G selecting transistor Mg interposed therebetween, and to the B data signal line Dbi with the B selecting transistor Mb interposed therebetween in the corresponding demultiplexer 41.

As illustrated in FIG. 2, the R pixel circuit 11*r*, the G pixel circuit 11*g*, and the B pixel circuit 11*b* are disposed in the extending direction of the scanning signal line in this order. Note that, the configurations of the R pixel circuit 11*r*, the G pixel circuit 11*g*, and the B pixel circuit 11*b* are basically the same. Thus, in the following, the parts common to one another in these pixel circuits are described by taking the configuration of the R pixel circuit 11*r* as an example, and the parts different from one another in these pixel circuits are described individually as appropriate.

The R pixel circuit 11*r* includes an organic EL element OLED, a drive transistor M1, a writing transistor M2, a compensating transistor M3, a first initialization transistor M4, a power-supplying transistor M5, a light emission control transistor M6, a second initialization transistor M7, and a data-holding capacitor C1 as a holding capacitance for holding a data voltage. The drive transistor M1 includes a gate terminal, a first conduction terminal, and a second conduction terminal. In the present embodiment, dual-gate transistors are used for the compensating transistor M3 and the first initialization transistor M4 in order to reduce an off-leak current, but usual single-gate transistors may be used. Note that, the G pixel circuit 11*g* and the B pixel circuit 11*b* also include elements similar to those of the R pixel circuit 11*r*, and the connection relationships between the elements of the G pixel circuit 11*g* and the B pixel circuit 11*b* are also the same as those of the R pixel circuit 11*r*.

To the R pixel circuit 11*r* are connected the corresponding scanning signal line (referred to as a "corresponding scanning signal line" for convenience of the description focusing on the pixel circuit) Sj, the scanning signal line Sj−1 immediately before the corresponding scanning signal line Sj (the last scanning signal line in the order of scanning of the scanning signal lines S1 to Sn, referred to as a "preceding scanning signal line" for convenience of the description focusing on the pixel circuit), the corresponding light emission control line (referred to as a "corresponding light emission control line" for convenience of the description focusing on the pixel circuit) Ej, the corresponding R data signal line (referred to as a "corresponding data signal line" for convenience of the description focusing on the pixel circuit) Dri, the high-level power source line ELVDD, the low-level power source line ELVSS, and the initialization line Vini. The G data signal line Dgi is connected to the G pixel circuit 11*g* as the corresponding data signal line in place of the R data signal line Dri. The other connections are the same as those of the R pixel circuit 11*r*. The B data signal line Dbi is connected to the B pixel circuit 11*b* as the corresponding data signal line in place of the R data signal line Dri. The other connections are the same as those of the R pixel circuit 11*r*. Note that, as described above, a data line capacitance Cdri is formed at the R data signal line Dri, a data line capacitance Cdgi is formed at the G data signal line Dgi, and a data line capacitance Cdbi is formed at the B data signal line Dbi (see FIG. 2).

In the R pixel circuit 11*r*, the gate terminal of the writing transistor M2 is connected to the corresponding scanning signal line Sj, and the source terminal of the writing transistor M2 is connected to the R data signal line Dri being the corresponding data signal line. In the G pixel circuit 11*g*, the gate terminal of the writing transistor M2 is connected to the corresponding scanning signal line Sj, and the source terminal of the writing transistor M2 is connected to the G data signal line Dgi being the corresponding data signal line. In the B pixel circuit 11*b*, the gate terminal of the writing transistor M2 is connected to the corresponding scanning signal line Sj, and the source terminal of the writing transistor M2 is connected to the B data signal line Dbi being the corresponding data signal line.

In each of the R pixel circuit 11*r*, the G pixel circuit 11*g*, and the B pixel circuit 11*b*, the writing transistor M2 supplies the voltage of the corresponding data signal line Dxi, that is, the data voltage held in the data line capacitance Cdxi to the drive transistor M1 in a case that the scanning signal line Sj is selected (x=r, g, b).

The first conduction terminal of the drive transistor M1 is connected to the drain terminal of the writing transistor M2. The drive transistor M1 supplies a drive current I corresponding to the source-gate voltage Vgs to the organic EL element OLED.

The compensating transistor M3 is provided between the gate terminal and the second conduction terminal of the drive transistor M1. The gate terminal of the compensating transistor M3 is connected to the corresponding scanning signal line Sj. The compensating transistor M3 brings the drive transistor M1 to a diode-connected state in a case that the scanning signal line Sj is selected.

The first initialization transistor M4 includes a gate terminal connected to the preceding scanning line Sj-1, and is provided between the gate terminal of the drive transistor M1 and the initialization line Vini. The first initialization transistor M4 initializes the gate voltage Vg of the drive transistor M1 in a case that the preceding scanning signal line Sj-1 is selected. In addition, the second initialization transistor M7 includes a gate terminal connected to the preceding scanning signal line Sj-1, and is provided between an anode of the organic EL element OLED and the initialization line Vini. The second initialization transistor M7 initializes a voltage of a parasitic capacitance present between the gate terminal of the drive transistor M1 and the anode of the organic EL element OLED in a case that the preceding scanning signal line Sj-1 is selected. Thus, the non-uniformity of luminance due to the influence of the previous frame image is reduced.

The power-supplying transistor M5 includes a gate terminal connected to the light emission control line Ej and is provided between the high-level power source line ELVDD and the first conduction terminal of the drive transistor M1. The power-supplying transistor M5 supplies the high-level power supply voltage ELVDD to the source terminal as the first conduction terminal of the drive transistor M1 in a case that the light emission control line Ej is selected.

The light emission control transistor M6 includes a gate terminal connected to the light emission control line Ej, and is provided between the drain terminal as the second conduction terminal of the drive transistor M1 and the anode of the organic EL element OLED. The light emission control transistor M6 transmits the drive current I to the organic EL element OLED in a case that the light emission control line Ej is selected.

The data-holding capacitor C1 includes a first terminal connected to the high-level power source line ELVDD and a second terminal connected to the gate terminal of the drive transistor M1. The data-holding capacitor C1 is charged with the voltage of the corresponding data signal line Dxi (data voltage) in a case that the corresponding scanning signal line Sj is in a select state, and holds the data voltage written by charging in a case that the scanning signal line Sj is in a non-select state, thereby maintaining the gate voltage Vg of the drive transistor M1.

The organic EL element OLED includes the anode connected to the second conduction terminal of the drive transistor M1 with the light emission control transistor M6 interposed therebetween and a cathode connected to the low-level power source line ELVSS. As a result, the organic EL element OLED emits light with a luminance in response to the drive current I.

1.3 Driving Method

Figure 3:
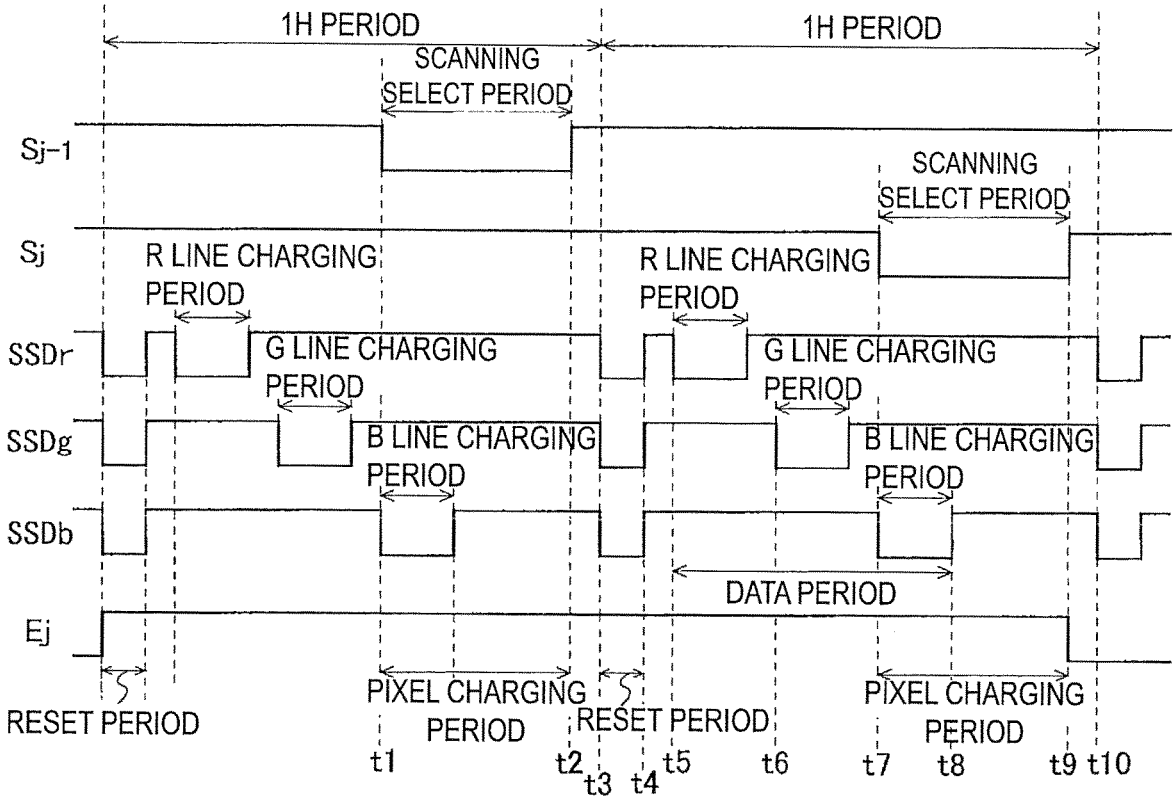
FIG. 3 is a signal waveform diagram illustrating a drive of a display device according to the first embodiment.
Figure 4:
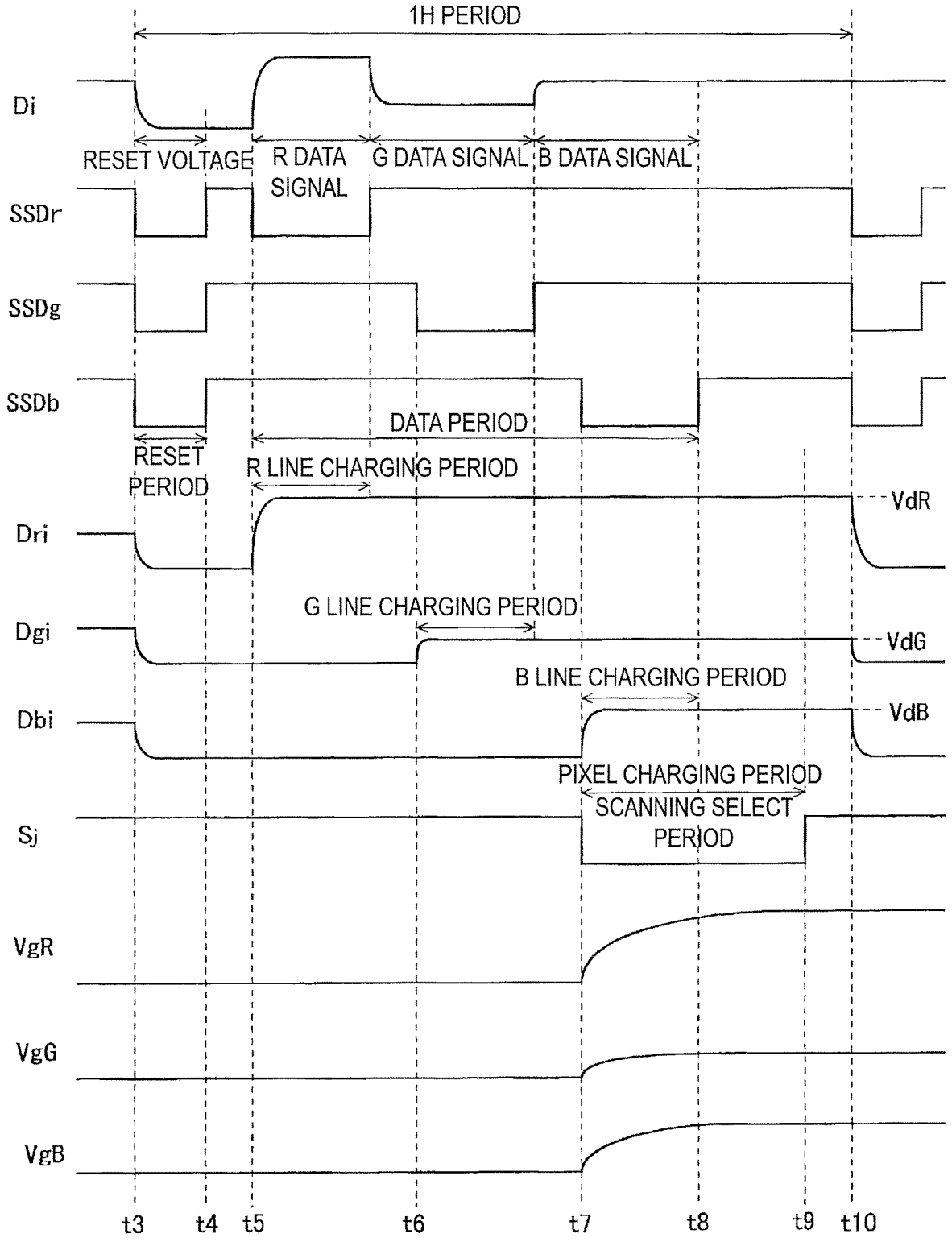
FIG. 4 is a signal waveform diagram illustrating an operation of a display device according to the present embodiment.

Next, with reference to FIG. 2, FIG. 3, and FIG. 4, a description is made on a driving method of the display device 1 according to the present embodiment. FIG. 3 is a signal waveform diagram illustrating a drive of the display device 1 according to the present embodiment, which is illustrated in FIG. 1 and FIG. 2. In FIG. 3, a focus is made on the three pixel circuits 11*r*, 11*g*, and 11*b*, which are connected to the same scanning signal line Sj and are connected to the same demultiplexer 41 with the three data signal lines Dri, Dgi, and Db interposed therebetween, and a waveform of signals for driving these pixel circuits 11*r*, 11*g*, and 11*b* is illustrated. FIG. 4 illustrates a detailed signal waveform during a 1H period for illustrating the operation of the display device 1 according to the present embodiment. Note that, the circuit element such as a transistor in the pixel circuits 11*r*, 11*g*, and 11*b* described below are operated similarly in any of these pixel circuits 11*r*, 11*g*, and 11*b* unless otherwise specified.

In the driving method illustrated in FIG. 3, the voltage of the corresponding light emission control line Ej is changed from the low level to the high level before the preceding scanning signal line Sj-1 is changed to the low level during a horizontal period (1H period) including the scanning select period during which the voltage of the preceding scanning signal line Sj-1 is at a low level (active). Thus, in the pixel circuits 11*r*, 11*g*, and 11*b*, the power-supplying transistor M5 and the light emission control transistor M6 are changed to the off state before the preceding scanning signal line Sj-1 is changed to the low level. With this, the organic EL element OLED is turns to a non-emitting state.

In addition, at the time t1, the voltage of the preceding scanning signal line Sj-1 is changed from the high level to the low level, and the preceding scanning signal line Sj-1 turns to a select state. Therefore, the first initialization transistor M4 turns to the on state. Thus, the gate voltage Vg of the drive transistor M1 is initialized to the initialization voltage Vini. The initialization voltage Vini is such a voltage that the drive transistor M1 can be kept in an on state during the writing of the data voltage into the pixel circuit. More specifically, the initialization voltage Vini satisfies Relationship (5) given below.

$$Vini - Vdata < -Vth \quad (5),$$

where Vdata is the data voltage (voltage of the corresponding data signal line Dri), and Vth (>0) is the threshold voltage of the drive transistor M1. This initialization operation allows the data voltage to be reliably written into the pixel circuit. Note that, at the time t1, the voltage of the preceding scanning signal line Sj-1 is changed from the high level to the low level, whereby the second initialization transistor M7 also turns to the on state. As a result, the voltage of the parasitic capacitance present between the gate terminal of the drive transistor M1 and the anode of the organic EL element PLED is initialized. This initialization operation by the second initialization transistor M7 is not directly involved with the disclosure, and hence the description thereof is omitted below (the same holds true in the other embodiments and the modified examples).

At the time t2, the voltage of the preceding scanning signal line Sj-1 is changed from the low level to the high level. In the present embodiment, before the data period and the scanning select period provided after the time t2, a reset period (from the time t3 to the time t4 illustrated in FIG. 3) is provided. Specifically, at the time t3, the R selection control signal SSDr, the G selection control signal SSDg, and the B selection control signal SSDb are all changed from the high level to the low level, and remain at the low level until the time t4. During the reset period, as illustrated in FIG. 4, the display control circuit 20 controls the data-side drive circuit 30 such that the reset voltage is output from each of the output terminals Tdi (i=1 to m) to the output line Di. Here, the reset voltage corresponds to an allowable minimum voltage of the data signal line during the scanning select period in the present embodiment, and is a voltage corresponding to white display (maximum luminance gray scale), that is, a white voltage. Note that, the reset voltage to be output from each of the output terminals Tdi of the data-side drive circuit 30 during the reset period is not limited to the white voltage. Specifically, the reset voltage is only required to be a voltage that initializes each data signal line Dxi in order to be capable of charging the data-holding capacitor C1 via the drive transistor M1 in the diode-connected state in the pixel circuit 11*x* regardless of the voltage that the data signal line Dxi may have during the scanning select period (x=r, g, b).

As apparent from FIG. 2, in the present embodiment, during the reset period from the time t3 to the time t4, the white voltage being the reset voltage is supplied to the data signal lines Dri, Dgi, and Dbi via the demultiplexer 41, and is respectively held in the data line capacitances Cdri, Cdgi, and Cdbi.

At the time t4 being a terminal time point of the reset period, the R selection control signal SSDr, the G selection control signal SSDg, and the B selection control signal SSDb are changed from the low level to the high level. After that, at the time t5, only the R selection control signal SSDr is changed from the high level to the low level (active). Note that, the R selection control signal SSDr may not be changed to the high level at the time t4, and may remain at the low level during the period from the time t4 to the time t5.

During the period from the time t5 to the time t8, the R selection control signal SSDr, the G selection control signal SSDg, and the B selection control signal SSDb are sequentially changed to the low level for a predetermined period. With this, the R selecting transistor Mr, the G selecting transistor Mg, and the B selecting transistor Mb in the demultiplexer 41 sequentially turn to the on state for the predetermined period. Meanwhile, as illustrated in FIG. 4, during the period from the time t5 to the time t8, the R data signal, the G data signal, and the B data signal are sequentially output from the output terminal Tdi of the data-side drive circuit 30 in conjunction with the R selection control signal SSDr, the G selection control signal SSDg, and the B selection control signal SSDb (hereinafter, the period during which the data signals are output from the output terminal Tdi of the data-side drive circuit 30 as described above is referred to as a "data period"). The voltages of the R data signal, the G data signal, and the B data signal that are sequentially output are supplied to the data signal lines Dri, Dgi, and Dbi by the demultiplexer 41, and are respectively held in the data line capacitances Cdri, Cdgi, and Cdbi. In this manner, during the period from the time t5 to the time t8, each set of the data signal lines Dri, Dgi, and Dbi is sequentially charged with the voltages of the R data signal, the G data signal, and the B data signal. Specifically, in the data period from the time t5 to the time t8, during the predetermined period during which the R selection control signal SSDr is at the low level, the data line capacitance Cdri being a wiring line capacitance of the R data signal line Dri is charged with the voltage of the R data signal (hereinafter, the predetermined period is referred to an "R line charging period"). During the predetermined period during which the G selection control signal SSDg is at the low level, the data line capacitance Cdgi being a wiring line capacitance of the G data signal line Dgi is charged with the voltage of the G data signal (hereinafter, the predetermined period is referred to a "G line charging period"). During the predetermined period during which the B selection control signal SSDb is at the low level, the data line capacitance Cdbi being a wiring line capacitance of the B data signal line Dbi is charged with the voltage of the B data signal (hereinafter, the predetermined period is referred to a "B line charging period"). As illustrated in FIG. 4, the voltage of the R data signal line Dri at a terminal point of the R line charging period is held as an R data voltage VdR until the reset period in the next 1H period (horizontal period). The voltage of the G data signal line Dgi at a terminal point of the G line charging period is held as a G data voltage VdG until the reset period in the next 1H period. The voltage of the B data signal line Dbi at a terminal point of the B line charging period is held as a B data voltage VdB until the reset period in the next 1H period.

During the data period from the time t5 to the time t8 described above, at the time t7 at which the B line charging period is started after the G line charging period is terminated, the voltage of the corresponding scanning signal line Sj is changed from the high level to the low level. With this, the corresponding scanning signal line Sj is in the select state. During the period during which the corresponding scanning signal line Sj is in the select state (scanning select period), the writing transistor M2 and the compensating transistor M3 are in the on state (see FIG. 2).

As described above, after the time t7 in the data period from the time t5 to the time t8, the voltage of the R data signal line Dri (the R data voltage held in the data line capacitance Cdri) VdR is supplied to the data-holding capacitor C1 in the R pixel circuit 11*r* via the drive transistor M1 in the diode-connected state. With this, as illustrated in FIG. 4, the gate voltage VgR of the drive transistor M1 is changed toward the value obtained by Equation (1) given above (note that, Vdata=VdR is satisfied). Further, after the time t7, the voltage of the G data signal line Dgi (the G data voltage held in the data line capacitance Cdgi) VdG is supplied to the data-holding capacitor C1 in the G pixel circuit 11*g* via the drive transistor M1 in the diode-connected state. With this, the gate voltage VgG of the drive transistor M1 is also changed toward the value obtained by Equation (1) given above (note that, Vdata=VdG is satisfied). Further, after the time t7, the voltage of the B data signal is supplied to the B data signal line Dbi, is held as the B data voltage VdB by the data line capacitance Cdbi, and is supplied to the data-holding capacitor C1 in the B pixel circuit 11*b* via the drive transistor M1 in the diode-connected state. With this, the gate voltage Vg of the drive transistor M1 is also changed toward the value obtained by Equation (1) given above (note that, Vdata=VdB is satisfied). As described above, during the scanning select period from the time t7 to the time t9, charging of the data-holding capacitor C1 is performed in each of the pixel circuits 11*r*, 11*g*, and 11*b* (hereinafter, the scanning select period is also referred to as a "pixel charging period").

After that, at the time t9, the voltage of the corresponding scanning signal line Sj is changed from the low level to the high level, and the scanning select period is terminated. Therefore, in each of the R pixel circuit 11*r*, the G pixel circuit 11*g*, and the B pixel circuit 11*b*, the writing transistor M2 and the compensating transistor M3 are changed to the off state.

Further, at the time t9, the voltage of the corresponding light emission control line Ej is changed from the high level to the low level (active) (see FIG. 3). Therefore, in each of the R pixel circuit 11*r*, the G pixel circuit 11*g*, and the B pixel circuit 11*b*, the power-supplying transistor M5 and the light emission control transistor M6 are changed to the on state. Thus, the drive current I corresponding to the gate voltage Vg of the drive transistor M1 and the high-level power source line ELVDD, that is, the drive current I corresponding to the voltage held in the data-holding capacitor C1 is supplied to the organic EL element OLED, and the organic EL element OLED emits light in response to the current value of the drive current I. In this case, the organic EL element OLED in the R pixel circuit 11*r* emits red light, the organic EL element OLED in the G pixel circuit 11*g* emits green light, and the organic EL element OLED in the B pixel circuit llb emits blue light. The drive current I is obtained by Equation (4) given above. The operation as described above is repeated n times during one frame period. With this, an image for one frame is displayed.

1.4 Effects

Figure 13:
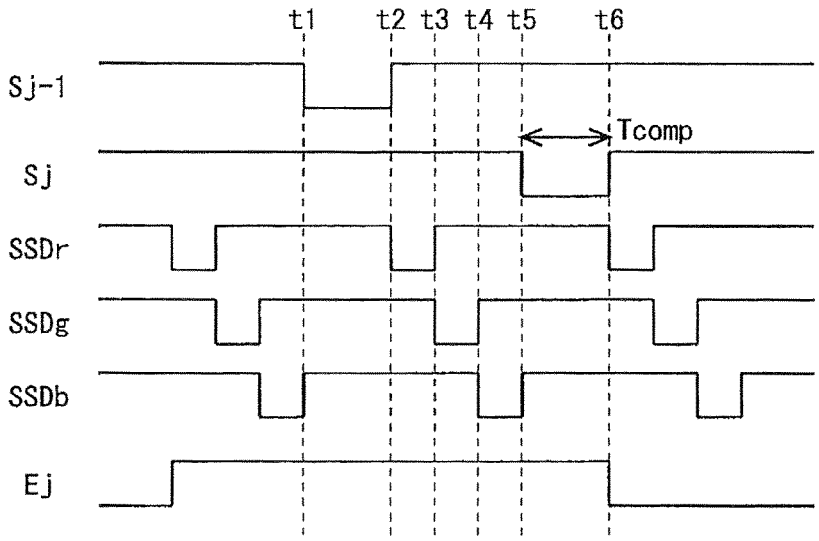
FIG. 13 is a timing chart illustrating a driving method of a pixel circuit illustrated in FIG. 12.

According to the present embodiment described above, as illustrated in FIG. 3 and FIG. 4, in the data period from the time t5 to the time t8, the period during which one selecting transistor Mb in each demultiplexer 41 is in the on state, that is, the B line charging period from the time t7 to the time t8 overlaps with the scanning select period (the select period of the corresponding scanning signal line Sj) from the time t7 to the time t9. Thus, as compared to the known example (FIG. 13), the charging period of the data signal lines Dri, Dgi, and Dbi and the charging period of the data-holding capacitor C1 in the pixel circuits 11*r*, 11*g*, and 11*b* can be increased.

Figure 14:
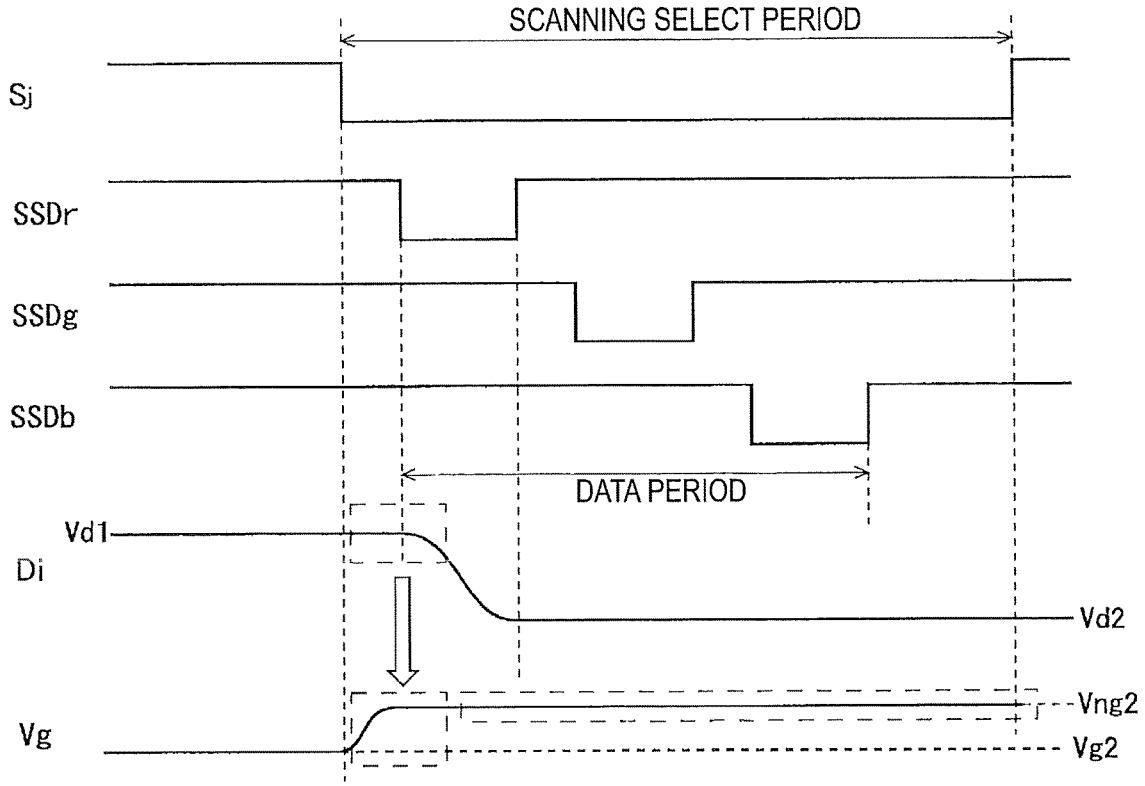
FIG. 14 is a signal waveform diagram illustrating a problem in a known organic EL display device.

Further, in the present embodiment, as illustrated in FIG. 4, in the rest period from the time t3 to the time t4 provided before the scanning select period from the time t7 to the time t9, the white voltage is suppled as the rest voltage to each data signal line Dxi (x=r, g, b). Thus, even in a case where (the B line charging period in) the data period and the scanning select period overlap with each other, the data writing failure caused by the diode-connection as illustrated in FIG. 14 does not occur.

As described above, according to the present embodiment, while avoiding the data writing failure caused by the diode-connection, (the B line charging period in) the data period and the scanning select period overlap with each other. With this, as compared to the known example (FIG. 13), the charging period of the data signal lines Dri, Dgi, and Dbi and the charging period of the data-holding capacitor C1 in the pixel circuits 11*r*, 11*g*, and 11*b* can be increased. With this, in the organic EL display device adopting the SSD method, sufficient charging of the data voltage and sufficient internal compensation in the pixel circuit can be performed even in a case that a display image has a higher resolution.

Figure 15:
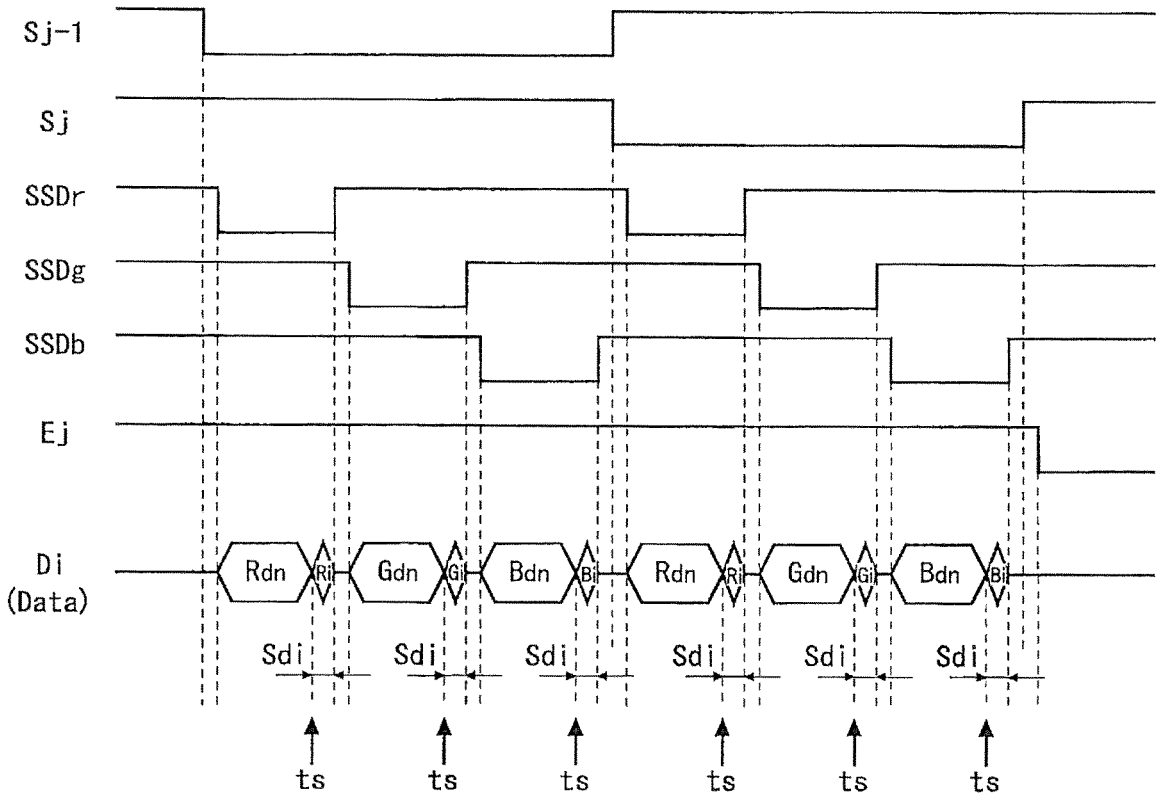
FIG. 15 is a signal waveform diagram illustrating a driving method in the second known example.

Note that, also in the second known example illustrated in FIG. 15, by providing the data line initialization stage Sdi in place of the reset period in the present embodiment, the data period and scanning select period can overlap with each other while avoiding the data writing failure caused by the diode-connection. However, the three data line initialization stages Sdi are included during which the scanning lines are in the select state (each scanning select period) during each horizontal period (1H period). With respect to this point, in the present embodiment, only one reset period is included in each horizontal period (1H period) (see FIG. 3 and FIG. 4). Therefore, the present embodiment is more advantageous than the second known example in the sense that sufficient charging of the data voltage and sufficient internal compensation in the pixel circuit can be performed even in a case that a display image has a higher resolution.

1.5 First Modified Example in First Embodiment

Figure 5:
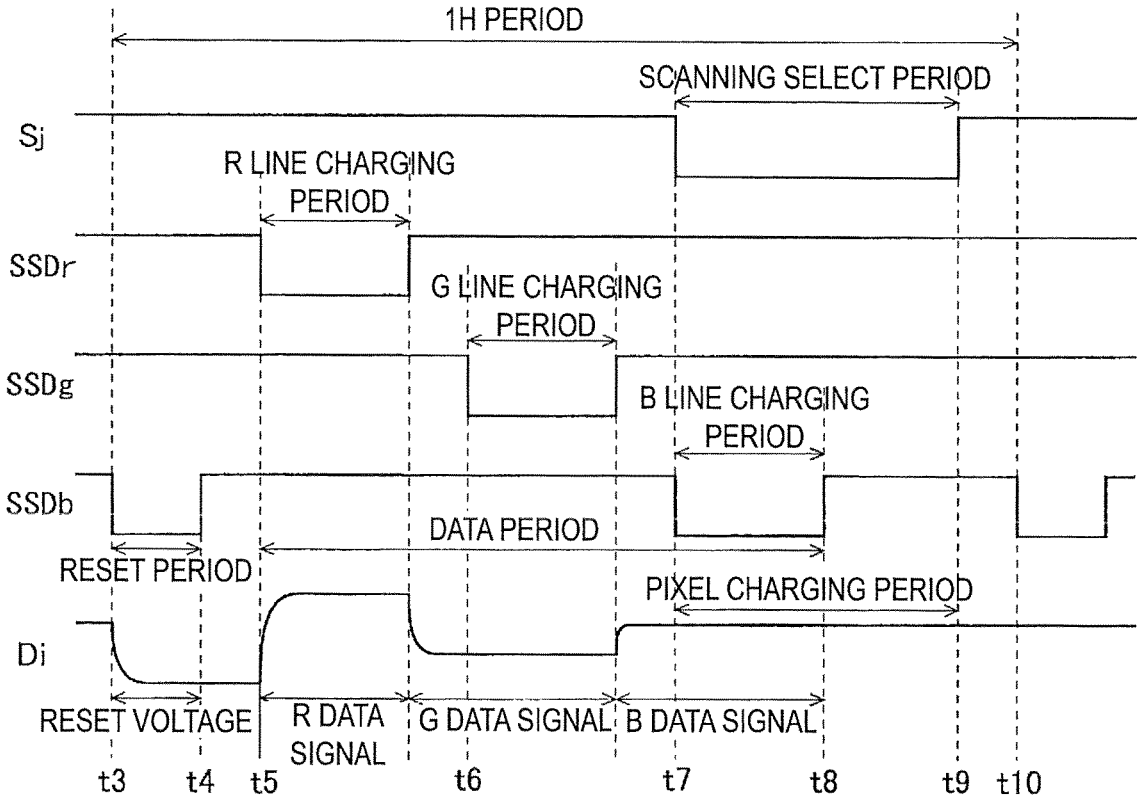
FIG. 5 is a signal waveform diagram illustrating an operation of a display device in a first modified example of the first embodiment.

In the first embodiment described above, as apparent from FIG. 4, the R line charging period (the period during which the R selecting transistor Mr is in the on state) and the G line charging period (the period during which the G selecting transistor Mg is in the on state) precede the select period (the scanning select period) of the corresponding scanning signal line Sj. Thus, with regard to any of the R data signal line Dri and the G data signal line Dgi, the data writing failure caused by the diode-connection (FIG. 14) does not occur even in a case that the reset voltage is not applied. Therefore, the display control circuit 20 may be configured such that the R selection control signal SSDr, the G selection control signal SSDg, and the B selection control signal SSDb illustrated in, for example, FIG. 5 are generated. In the following, the thus configured modified example in the first embodiment is referred to as the "first modified example."

In the present modified example, similarly to the first embodiment described above, for the B selection control signal SSDb, the rest period from the time t3 to the time t4 is provided before the select period (scanning select period) of the corresponding scanning signal line Sj from the time t7 to the time t9. In the reset period, the white voltage (the minimum voltage that the data signal line may have) is output as the rest voltage from each output terminal TDi of the data-side drive circuit 30. However, as illustrated in FIG. 5, the rest period is not provided for any of the R selection control signal SSDr and the G selection control signal SSDg. The other configurations in the present modified example are the same as those in the first embodiment described above. According to the present modified example described above, the effects similar to those in the first embodiment described above can be obtained, and the number of data signal lines to which the reset voltage is to be applied is reduced to one third. Thus, power required for the operation of applying the reset voltage to the data signal lines so as to avoid the data writing failure caused by the diode-connection (FIG. 14) (hereinafter, referred to as "line initialization") is reduced.

1.6 Second Modified Example in First Embodiment

Figure 6:
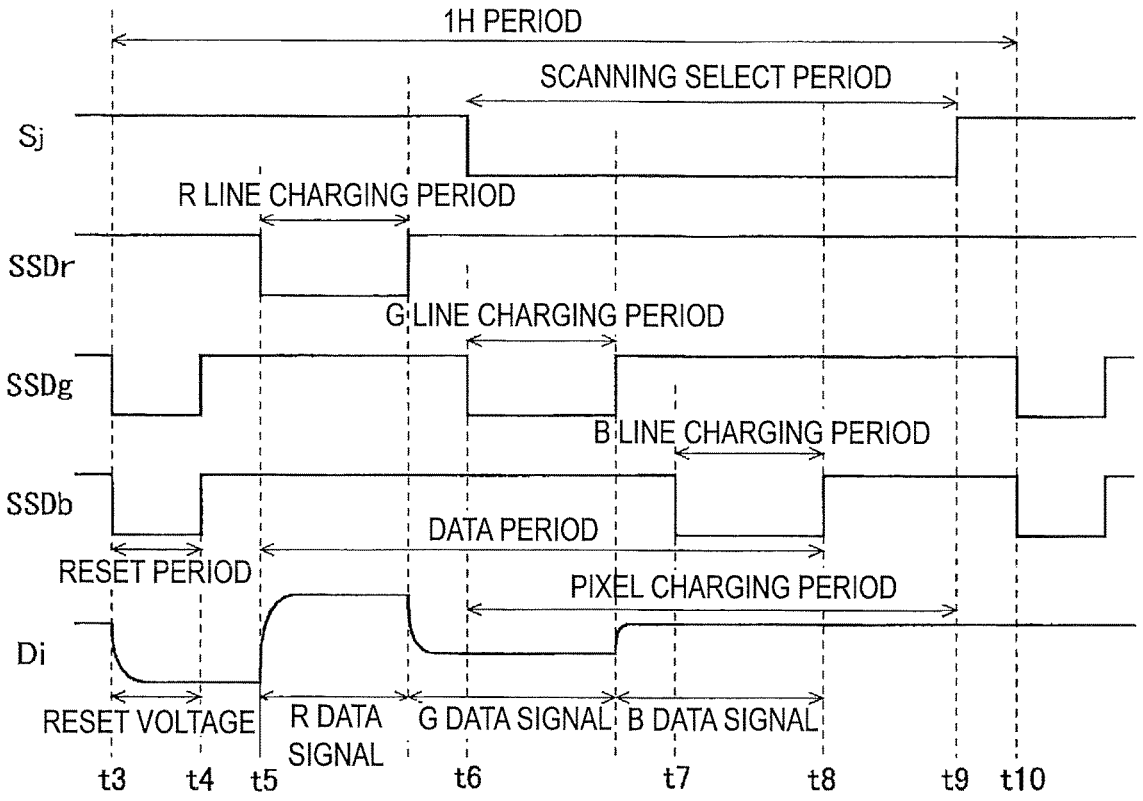
FIG. 6 is a signal waveform diagram illustrating an operation of a display device in a second modified example of the first embodiment.

In the first embodiment described above, only the period from the time t7 to the time t8 during which the selecting transistor Mb being one of the three selecting transistors Mr, Mg, and Mb in each demultiplexer 41 is in the on state (the period during which the B selection control signal SSDb is at the low level, that is, the B line charging period) overlaps with the scanning select period from the time t7 to the time t9. However, as illustrated in FIG. 6, a configuration is possible in which both the periods during which the two selecting transistors Mg and Mb are in the on state (the G line charging period and the B line charging period) overlap with the scanning select period from the time t7 to the time t9. In the following, the thus configured modified example in the first embodiment is referred to as the "second modified example."

In the present modified example, not only the B line charging period (the period during which the B selecting transistor Mb is in the on state) but also the G line charging period (the period during which the G selecting transistor Mg is in the on state) overlaps with the scanning select period. However, the reset period is provided for each of the B selection control signal SSDb and the G selection control signal SSDg. Thus, the data writing failure caused by the diode-connection (FIG. 14) does not occur. The other configurations in the present modified example are the same as those in the first embodiment described above. According to the present modified example described above, while avoiding the data writing failure caused by the diode-connection, the charging period of the data signal lines Dri, Dgi, and Dbi and the charging period of the data-holding capacitor C1 in the pixel circuits 11*r*, 11*g*, and 11*b* can be increased more than those in the first embodiment described above. Further, as compared to the first embodiment described above, the number of data signal lines to which the rest voltage is to be applied is reduced to two thirds, and hence, power required for the line initialization can be reduced.

Note that, in a more general sense, among the R, G, and B selecting transistors Mr, Mg, and Mb in each demultiplexer 41, with respect to the selecting transistor Mx controlled to be in the on/off states by the selection control signal SSDx (x is any one of r, g, and b) provided with the reset period during which the selection control signal SSDX tunes to the active state after the preceding scanning signal line Sj-1 is changed to the non-select state and before the corresponding scanning signal line Sj is changed to the select state, the line charging period corresponding to the on period can overlap with the select period of the corresponding scanning signal line Sj without the data writing failure caused by the diode-connection. Specifically, in a case that the selecting transistor Mx (x is any one of r, g, and b), which is in the on state during the scanning select period, is included in the selecting transistor My (y is any one of r, g, and b) which is in the on state during the reset period described above, the data writing failure caused by the diode-connection does not occur. For example, in the first embodiment and the first modified example, only the selecting transistor Mb is in the on state during the scanning select period (FIG. 3 and FIG. 5). In the first embodiment, all the selecting transistors Mr, Mg, and Mb are in the on state during the reset period (FIG. 3), and in the first modified example, the selecting transistor Mb is in the on state during the reset period (FIG. 5). Thus, the data writing failure caused by the diode-connection does not occur. Further, for example, in the second modified example, the selecting transistors Mg and Mb are in the on state during the scanning select period, but these selecting transistors Mg and Mb are in the on state during the reset period (FIG. 6). Thus, the data writing failure caused by the diode-connection does not occur. Note that, as in the first embodiment, in a case that all the selecting transistors Mr, Mg, and Mb are in the on state during the reset period, all the selecting transistors Mr, Mg, and Mb may be in the on state during the scanning select period. However, as illustrated in FIG. 3, according to the configuration in which only the one selecting transistor Mb is in the on state during the scanning select period, a difference in charging rate of the data-holding capacitor C1 is less likely to occur among the pixel circuits 11*r*, 11*g*, and 11*b*, and hence luminance variation is small.

2. Second Embodiment

2.1 Overall Configuration

Figure 7:
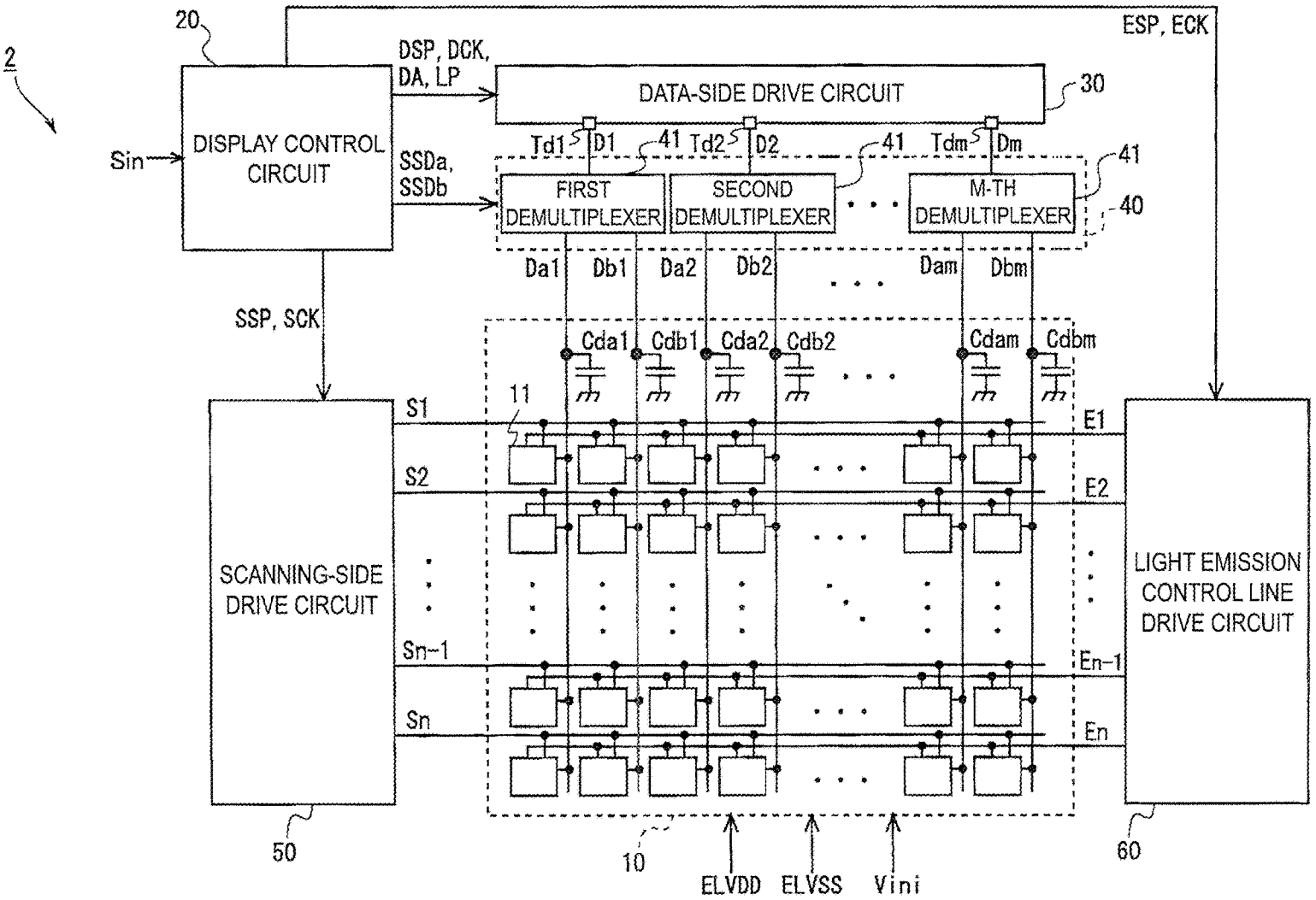
FIG. 7 is a block diagram illustrating an overall configuration of a display device according to a second embodiment.

FIG. 7 is a block diagram illustrating an overall configuration of a display device 2 according to a second embodiment. This organic EL display device 2 is also an organic EL display device adopting the SSD method for performing internal compensation, and as illustrated in FIG. 7, includes the display unit 10, the display control circuit 20, the data-side drive circuit (data driver) 30, the demultiplexer unit 40, the scanning-side drive circuit (scanning driver) 50, and the light emission control line drive circuit (emission driver) 60.

The display unit 10 includes m×k (m and k are integers equal to or more than 2) data signal lines disposed therein. In the present embodiment, k=2 is satisfied, which is different from the first embodiment where K=3 is satisfied. That is, in the present embodiment, in the display unit 10, 2m data signal lines Da1, Db1, Da2, Db2, . . . , Dam, and Dbm and n scanning signal lines S1 to Sn intersecting these data signal lines are disposed, and n light emission control lines (emission lines) E1 to En are respectively disposed along the n scanning signal lines S1 to Sn. Further, as illustrated in FIG. 7, the display unit 10 is provided with the 2m×n pixel circuits 11, and those 2m×n pixel circuits 11 are arranged in a matrix shape along the 2m data signal lines Dx1 to Dxm (x=a, b) and the n scanning signal lines S1 to Sn in such a manner that each of these 2m×n pixel circuits 11 corresponds to any one of the 2m data signal lines Dx1 to Dxm (x=a, b) and also corresponds to any one of the n scanning signal lines S1 to Sn and any one of the n light emission control lines E1 to En. The 2m data signal lines Dx1 to Dxm (x=a, b) are connected to the demultiplexer unit 40, the n scanning signal lines S1 to Sn are connected to the scanning-side drive circuit 50, and the n light emission control lines E1 to En are connected to the light emission control line drive circuit 60.

Further, similarly to the first embodiment, in the display unit 10, the high-level power source line ELVDD and the low-level power source line ELVSS are disposed as power source lines (not illustrated) common in each pixel circuit 11, and the initialization line Vini for supplying the initialization voltage Vini is disposed. These voltages are supplied from a power source circuit (not illustrated).

In FIG. 7, each of the wiring line capacitances Cda1 to Cdam formed at the m data signal lines Da1 to Dam (hereinafter, also referred to as "A data signal lines Da1 to Dam") is illustrated as a capacitor, and each of the wiring line capacitances Cdb1 to Cdbm formed at the other m data signal lines Db1 to Dbm (hereinafter, also referred to as "B data signal lines Db1 to Dbm") is illustrated as a capacitor (hereinafter, those wiring line capacitances Cdxi (x=a, b; i=1 to m) are referred to as "data line capacitances"). A ground voltage is applied to one end (on a side not connected to the data signal line Dxi) of each data line capacitance Cdxi, but the disclosure is not limited thereto.

The display control circuit 20 receives an input signal Sin including image information representing an image to be displayed and timing control information for image display from the outside of the display device 2, and on the basis of the input signal Sin, outputs various control signals to the data-side drive circuit 30, the demultiplexer unit 40, the scanning-side drive circuit 50, and the light emission control line drive circuit 60. More specifically, the display control circuit 20 outputs a data start pulse DSP, a data clock signal DCK, display data DA, and a latch pulse LP to the data-side drive circuit 30. The display control circuit 20 also outputs an A selection control signal SSDa and a B selection control signal SSDb to the demultiplexer unit 40. Furthermore, the display control circuit 20 outputs a scan start pulse SSP and a scan clock signal SCK to the scanning-side drive circuit 50. Furthermore, the display control circuit 20 outputs a light emission control start pulse ESP and a light emission control clock signal ECK to the light emission control line drive circuit 60.

Similarly to the first embodiment, the data-side drive circuit 30 includes an m-bit shift register, a sampling circuit, a latch circuit, m D/A converters, and the like, which are not illustrated. The m D/A converters correspond to the m output lines D1 to Dm respectively connected to m output terminals Td1 to Tdm of the data-side drive circuit 30, and supply the analog data signals based on the display data DA to the output lines D1 to Dm. The display device 2 according to the present embodiment adopts the SSD method, and hence the A data signal and the B data signal are supplied to each output line Di sequentially (in a time-division manner). Here, the A data signal is a data signal to be applied to A data signal lines Da1 to Dam being odd-numbered data signal lines among the 2m data signal lines Dx1 to Dxm (x=a, b) in the display unit 10, and the B data signal is a data signal to be applied to the B data signal lines Db1 to Dbm being even-numbered data signal lines.

The demultiplexer unit 40 includes m demultiplexers 41 which are first to m-th demultiplexers 41 respectively corresponding to the m output terminals Td1 to Tdm of the data-side drive circuit 30. The input terminal of the i-th demultiplexer is connected to the corresponding output terminal Tdi of the data-side drive circuit 30 with the output line Di interposed therebetween (i=1 to m). The i-th demultiplexer 41 includes two output terminals, and these two output terminals are respectively connected to two data signal lines Dai and Dbi, which is different from the first embodiment. The i-th demultiplexer 41 supplies the A data signal and the B data signal sequentially supplied from the output terminal Tdi of the data-side drive circuit 30 via the output line Di respectively to the A data signal line Dai and the B data signal line Dbi. The action of each demultiplexer 41 is controlled by the A selection control signal SSDa and the B selection control signal SSDb.

The scanning-side drive circuit 50 drives the n scanning signal lines S1 to Sn similarly to the first embodiment. More specifically, the scanning-side drive circuit 50 includes a shift register, buffers, and the like (not illustrated). The shift register sequentially transfers the scan start pulse SSP in synchronization with the scan clock signal SCK. The scanning signal being the output from each stage of the shift register is supplied to the corresponding scanning signal line Sj (j=1 to n) via a buffer. The 2m pixel circuits 11 connected to the scanning line Sj are collectively selected by the active (low level) scanning signals.

The light emission control line drive circuit 60 drives n light emission control lines E1 to En. More specifically, the light emission control line drive circuit 60 includes a shift register, buffers, and the like (not illustrated). The shift register sequentially transfers the light emission control start pulse ESP in synchronization with the light emission control clock signal ECK. The light emission control signal being the output from each stage of the shift register is supplied to the corresponding light emission control line Ej (j=1 to n) via a buffer.

As illustrated in FIG. 7, similarly to the first embodiment, the scanning-side drive circuit 50 is separated from the light emission control line drive circuit 60, is disposed on one end side of the display unit 10 (the left side of the display unit 10 in FIG. 7), and the light emission control line drive circuit 60 is disposed on the other end side of the display unit 10 (the right side of the display unit 10 in FIG. 7). However, the scanning-side drive circuit 50 is not limited to the above-mentioned arrangement and configuration.

2.2 Connection Relation Between Pixel Circuit and Various Wiring Lines

Figure 8:
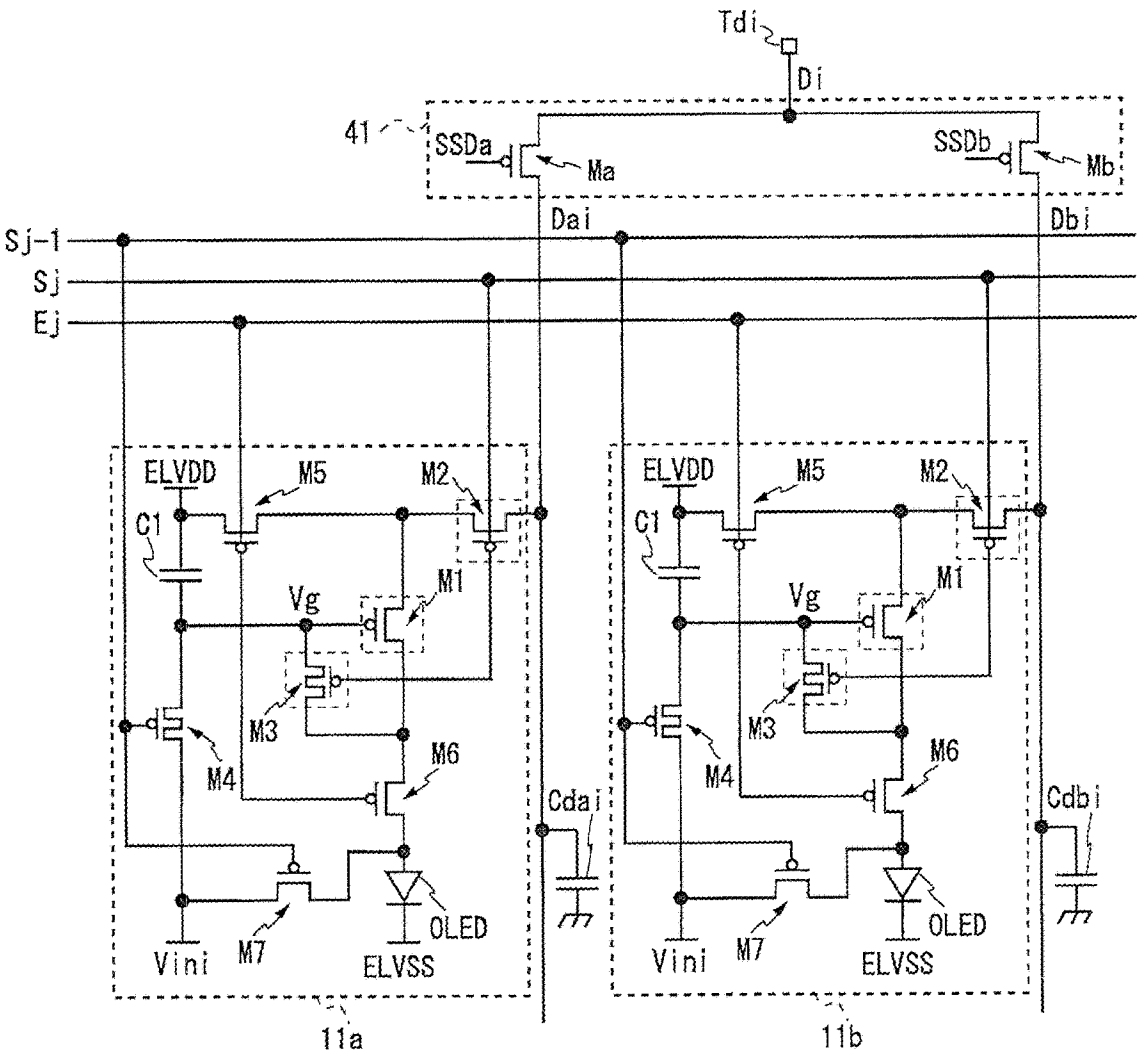
FIG. 8 is a circuit diagram illustrating a connection relationship between pixel circuits and various wiring lines in the second embodiment.

FIG. 8 is a circuit diagram illustrating a connection relationship between a part of pixel circuits 11*a* and 11*b* and various wiring lines in the present embodiment. Among the 2m×n pixel circuits 11 in the display unit 10, these pixel circuits 11*a* and 11*b* are connected to the same scanning signal line Sj, and are connected to the same demultiplexer 41 with the two data signal lines Dai and Dbi interposed therebetween. Here, the reference symbol "11*a*" is used to indicate the pixel circuit 11 connected to the A data signal line Dai (hereinafter, also referred to as an "A pixel circuit"), and the reference symbol "11*b*" is used to indicate the pixel circuit 11 connected to the B data signal line Dbi (hereinafter, also referred to as a "B pixel circuit").

As illustrated in FIG. 8, each demultiplexer 41 includes an A selecting transistor Ma and a B selecting transistor Mb. An A selection control signal SSDa is supplied to the gate terminal as a control terminal of the A selecting transistor Ma, and a B selection control signal SSDb is supplied to the gate terminal as a control terminal of the B selecting transistor Mb. The drain terminals as first conduction terminals of these selecting transistors Ma and Mb are respectively connected to the data signal lines Dai and Dbi, and all of the source terminals as second conduction terminals of these selecting transistors Ma and Mb are connected to the output line Di (i=1 to m). Therefore, each output line Di is connected to the A data signal line Dai with the A selecting transistor Ma interposed therebetween and to the B data signal line Dbi with the B selecting transistor Mb interposed therebetween in the corresponding demultiplexer 41.

As illustrated in FIG. 8, the A pixel circuit 11*a* and the B pixel circuit 11*b* are disposed in the extending direction of the scanning signal line in this order. Note that, the configurations of the A pixel circuit 11*a* and the B pixel circuit 11*b* are basically the same. Thus, in the following, the parts common to one another in these pixel circuits are described by taking the configuration of the A pixel circuit 11*a* as an example, and the parts different from one another in these pixel circuits are described individually as appropriate.

Similarly to the R pixel circuit 11*r*, the G pixel circuit 11*g*, and the B pixel circuit 11*b* in the first embodiment, the A pixel circuit 11*a* includes the organic EL element OLED, the drive transistor M1, the writing transistor M2, the compensating transistor M3, the first initialization transistor M4, the power-supplying transistor M5, the light emission control transistor M6, the second initialization transistor M7, and the data-holding capacitor C1 being a holding capacitance for holding the data voltage, and the connection relationships between these elements is the same as those in the first embodiment (see FIG. 2 and FIG. 8). Note that, the B pixel circuit 11*b* also includes elements similar to those of the A pixel circuit 11*a*, and the connection relationships between the elements of the B pixel circuit 11*b* are also the same as those of the A pixel circuit 11*a* (see FIG. 8).

To the A pixel circuit 11*a*, the scanning signal line Sj corresponding thereto (corresponding scanning signal line), the scanning signal line Sj-1 preceding the corresponding scanning signal line Sj (the preceding scanning signal line), the light emission control line Ej corresponding thereto (corresponding light emission control line), the A data signal line Dai corresponding thereto (corresponding data signal line), the high-level power source line ELVDD, the low-level power source line ELVSS, and the initialization line Vini are connected. The B data signal line Dbi is connected to the B pixel circuit 11*b* as the corresponding data signal line in place of the A data signal line Dai. The other connections are the same as those of the A pixel circuit 11*a*. Note that, a data line capacitance Cdai is formed at the A data signal line Dai, and a data line capacitance Cdbi is formed at the B data signal line Dbi (see FIG. 8).

In the A pixel circuit 11*a*, the gate terminal of the writing transistor M2 is connected to the corresponding scanning signal line Sj, and the source terminal of the writing transistor M2 is connected to the corresponding data signal line Dai. In the B pixel circuit 11*b*, the gate terminal of the writing transistor M2 is connected to the corresponding scanning signal line Sj, and the source terminal of the writing transistor M2 is connected to the corresponding data signal line Dbi.

In each of the A pixel circuit 11*a* and the B pixel circuit 11*b*, the writing transistor M2 supplies the voltage of the corresponding data signal line Dxi, that is, the data voltage held in the data line capacitance Cdxi to the drive transistor M1 in a case that the corresponding scanning signal line Sj is selected (x=a, b).

The configurations (wiring lines and connection relationships) other than those described above in each of the A pixel circuit 11*a* and the B pixel circuit 11*b* are similar to the configurations of the R pixel circuit 11*r*, the G pixel circuit 11*g*, and the B pixel circuit 11*b* in the first embodiment. Thus, the description therefor is omitted (see FIG. 2 and FIG. 8).

2.3 Driving Method

Figure 9:
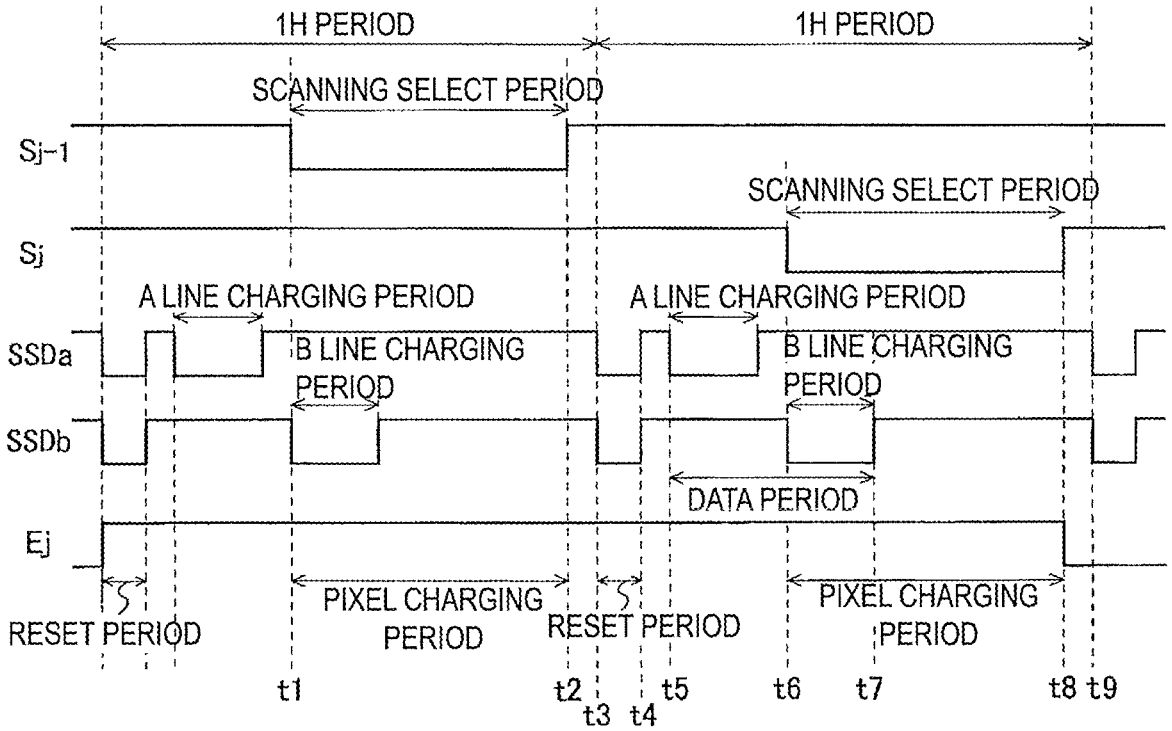
FIG. 9 is a signal waveform diagram illustrating a drive of a display device according to the second embodiment.
Figure 10:
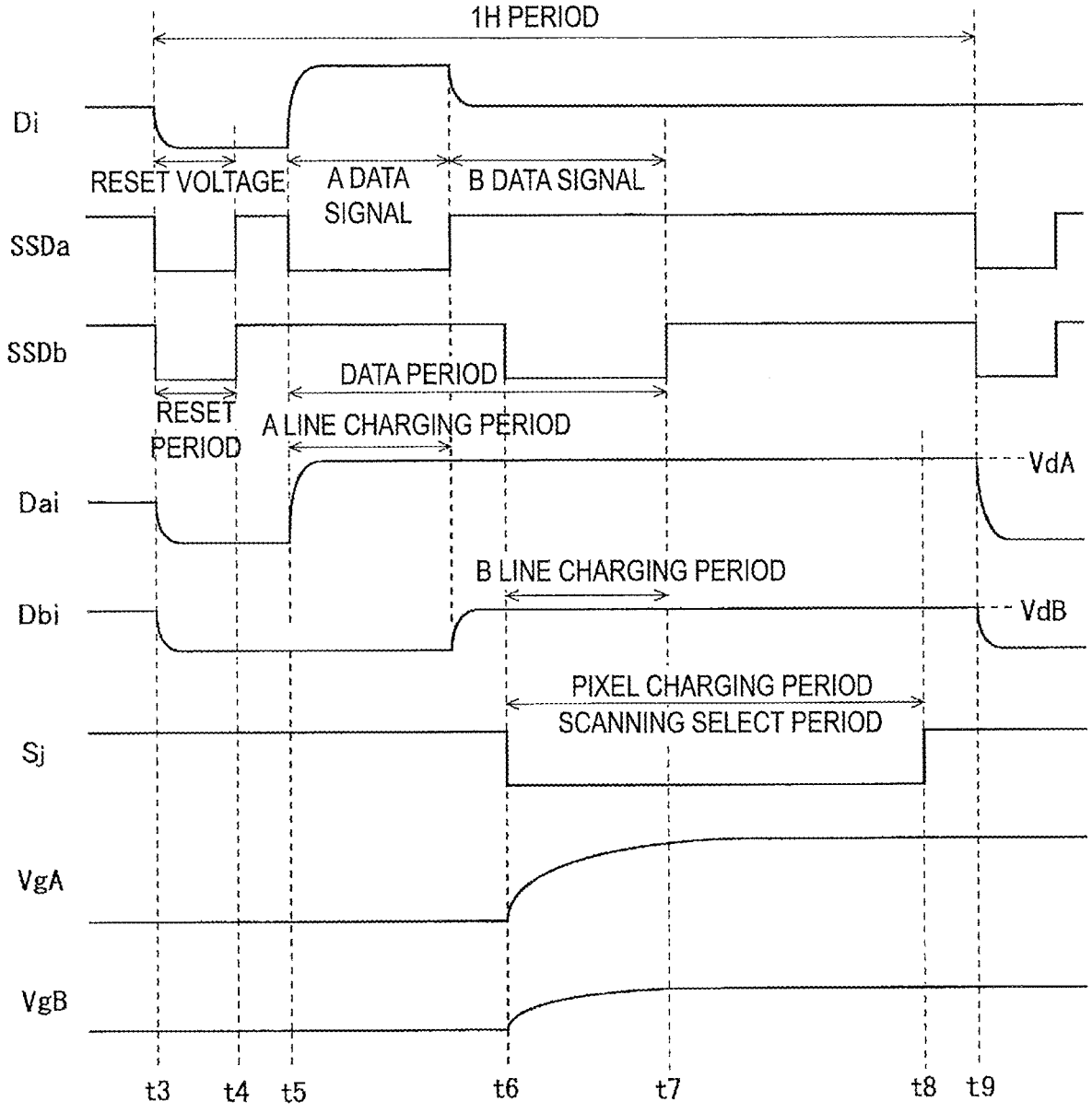
FIG. 10 is a signal waveform diagram illustrating an operation of a display device according to the second embodiment.

FIG. 9 is a signal waveform diagram illustrating a drive of the display device 2 according to the present embodiment, which is illustrated in FIG. 7 and FIG. 8. In FIG. 9, a focus is given on the two pixel circuits 11*a* and 11*b*, which are connected to the same scanning signal line Sj and are connected to the same demultiplexer 41 with the two data signal lines Dai and Db interposed therebetween, and a waveforms of signals for driving these pixel circuits 11*a* and 11*b* is illustrated. FIG. 10 illustrates a detailed signal waveform during the 1H period for illustrating the operation of the display device 2 according to the present embodiment. Note that, the circuit element such as a transistor in the pixel circuits 11*a* and 11*b* described below are operated similarly in any of these pixel circuits 11*a* and 11*b* unless otherwise specified.

FIG. 9 corresponds to FIG. 3 illustrating a signal waveform illustrating the drive of the display device 1 according to the first embodiment (FIG. 1 and FIG. 2), and FIG. 10 corresponds to FIG. 4 illustrating a detailed signal waveform during the 1H period for illustrating the operation of the display device 1 according to the first embodiment. In the present embodiment, the SSD method with multiplicity of 2 is adopted. Thus, in FIG. 9, the signal waveform of the R selection control signal SSDr, the G selection control signal SSDg, and the B selection control signal SSDb illustrated in FIG. 3 is replaced with the signal waveform of the A selection control signal SSDa and the B selection control signal SSDb. Further, similarly, in FIG. 10, the signal waveform of the R selection control signal SSDr, the G selection control signal SSDg, and the B selection control signal SSDb illustrated in FIG. 4 is replaced with the signal waveform of the A selection control signal SSDa and the B selection control signal SSDb. The signal waveform (voltage waveform) of the R data signal line Dri, the G data signal line Dgi, and the B data signal line Dbi illustrated in FIG. 4 is replaced with the signal waveform (voltage waveform) of the A data signal line Dai and the B data signal line Dbi. The waveform of the gate voltage VgR of the drive transistor M1 in the R pixel circuit 11*r*, the gate voltage VgG of the drive transistor M1 in the G pixel circuit 11*g*, and the gate voltage VgB of the drive transistor M1 in the B pixel circuit 11*b*, which is illustrated in FIG. 4, is replaced with the waveform of the gate voltage VgA of the drive transistor M1 in the A pixel circuit 11*a* and the voltage VgB of the drive transistor M1 in the B pixel circuit 11*b*. Further, as the signal waveform of the output line Di connected to the output terminal Tdi of the data-side drive circuit 30, FIG. 4 illustrates the signal waveform indicating that the R data signal, the G data signal, and the B data signal are sequentially output after the reset voltage is output. However, as the signal waveform of the output line Di, FIG. 9 illustrates the signal waveform indicating that the A data signal and the B data signal are sequentially output after the reset voltage is output. The drive and the operation of the display device 2 according to the present embodiment have the above-mentioned differences with respect to the first embodiment, but are basically similar to the drive and the operation of the display device 1 according to the first embodiment. Therefore, the driving method according to the present embodiment is apparent to a person skilled in the art from FIG. 8 to FIG. 10 and the description on the driving method that has been already given in the first embodiment, and hence detailed description is omitted.

2.4 Effects

According to the present embodiment, similarly to the first embodiment, as illustrated in FIG. 9 and FIG. 10, in the data period being the period from the time t5 to the time t7, the period (B line charging period) from the time t6 to the time t7 during which one selecting transistor Mb in each demultiplexer 41 is in the on state overlaps with the scanning select period (pixel charging period) from the time t6 to the time t8. Thus, as compared to the known example (FIG. 13), the charging period of the data signal lines Dai and Dbi and the charging period of the data-holding capacitor C1 in the pixel circuits 11*a* and 11*b* can be increased.

Further, according to the present embodiment, similarly to the first embodiment, as illustrated in FIG. 10, the rest period from the time t3 to the time t4 is provided before the scanning select period from the time t6 to the time t8, and during the rest period from the time t3 to the time t4, the white voltage is supplied as the rest voltage to each data signal line Dxi (x=a, b). Thus, even in a case that (the B line charging period in) the data period from the time t5 to the time t7 and the scanning select period from the time t6 to the time t8 overlap with each other, the data writing failure caused by the diode-connection as illustrated in FIG. 14 does not occur.

Therefore, also in the present embodiment, while avoiding the data writing failure caused by the diode-connection, the data period and the scanning select period overlap with each other. With this, the charging period of the data signal lines Dai and Dbi and the charging period of the data-holding capacitor C1 in the pixel circuits 11*a* and *b* can be increased. With this, in the organic EL display device adopting the SSD method, sufficient charging of the data voltage in the pixel circuit and sufficient internal compensation can be performed even in a case that a display image has a higher resolution.

2.5 Modified Example in Second Embodiment

Figure 11:
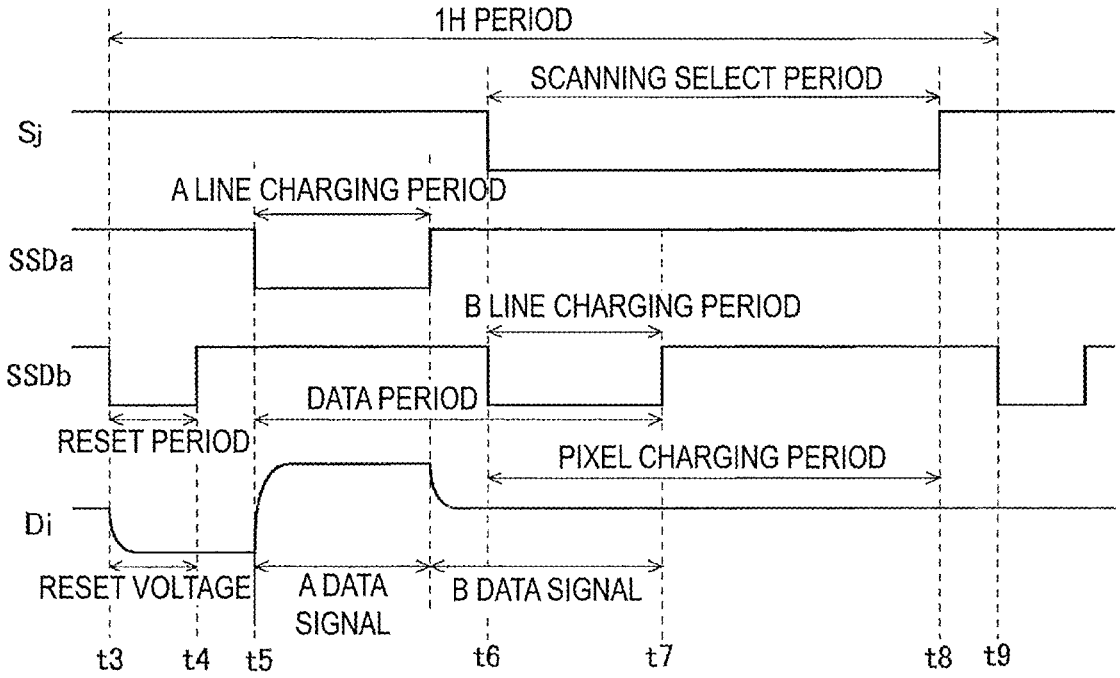
FIG. 11 is a signal waveform diagram illustrating an operation of a display device in a modified example of the second embodiment.
Figure 12:
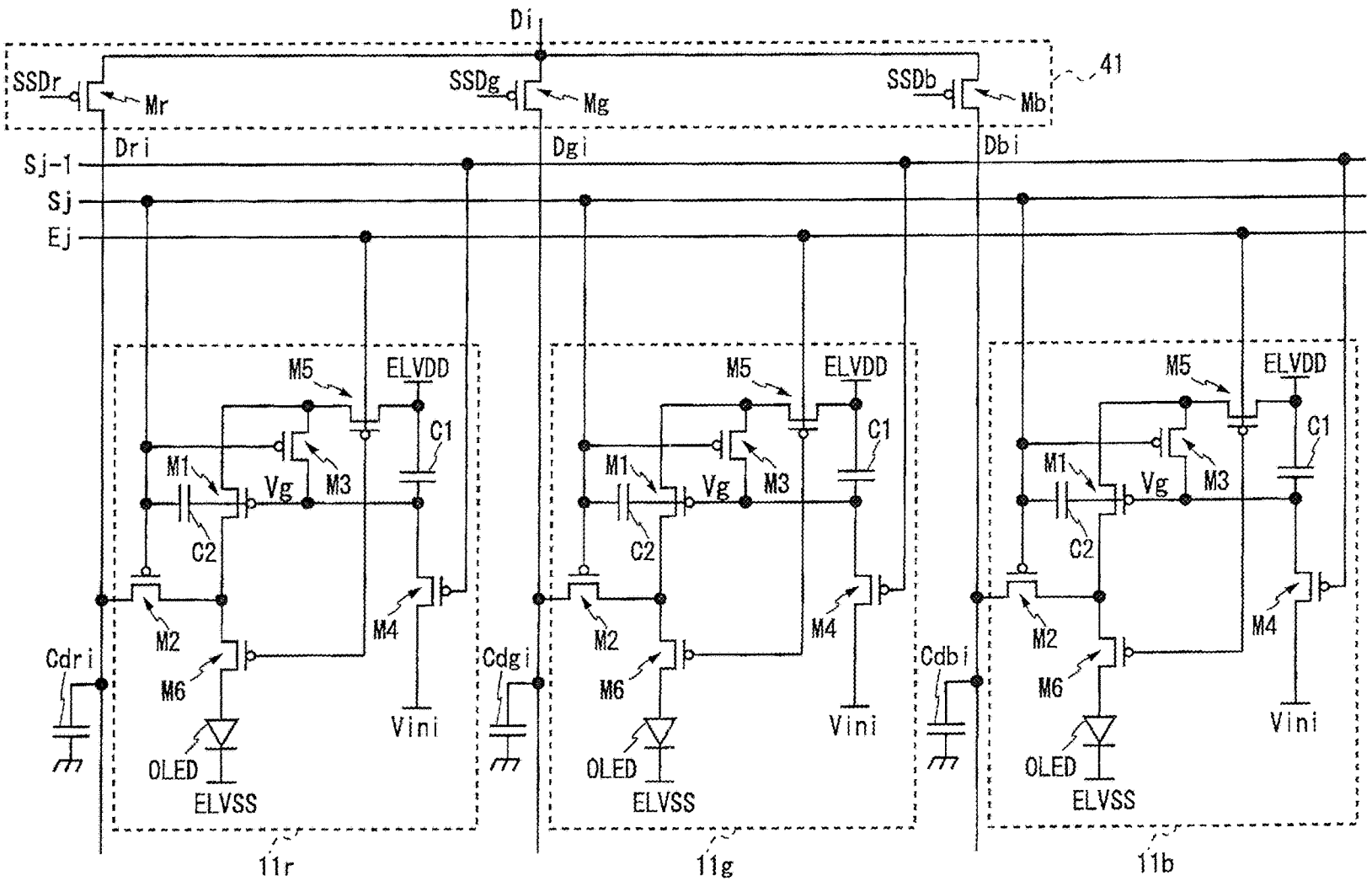
FIG. 12 is a circuit diagram illustrating a connection relationship between pixel circuits and various wiring lines in a first known example and a signal waveform diagram illustrating a problem.

In the present embodiment, modification can be made similarly to the first modified example (FIG. 5) in the first embodiment. FIG. 11 is a signal waveform diagram illustrating an operation of the display device according to the modified example in the present embodiment.

In the present modified example, similarly to the second embodiment, the rest period from the time t3 to the time t4 is provided for the B selection control signal SSDb before the select period of the corresponding scanning signal line Sj (scanning select period) from the time t6 to the time t8. During the rest period from the time t3 to the time t4, the white voltage (the minimum voltage that the data signal line may have) is output as the rest voltage from each output terminal Tdi of the data-side drive circuit 30. However, as illustrated in FIG. 11, the reset period is not provided for the A selection control signal SSDa. The other configurations in the present modified example are the same as those in the second embodiment. According to the present modified example, the effects similar to those in the second embodiment can be obtained, and the number of data signal lines to which the rest voltage is to be applied is halved. Thus, power required for the line initialization so as to avoid the data writing failure caused by the diode-connection (FIG. 14) is reduced.

3. Other Modified Examples

The disclosure is not limited to each of the embodiments and each of the modified example, and various modifications can be made without departing from the scope of the disclosure.

For example, in each of the embodiments, during the reset period provided for avoiding the data writing failure caused by the diode-connection (FIG. 14), the white voltage is applied as the rest voltage to each data signal line Dxi (x=r, g, b or x=a, b). However, the reset voltage is not limited to the white voltage, and is only required to be the minimum voltage that the data signal line Dxi may have during the scanning select period or a voltage lower than the minimum voltage. Further, in each of the embodiments, the corresponding data signal line Dxi corresponds to the anode side of the drive transistor M1 in the diode-connected state. However, in a case where the corresponding data signal line Dxi corresponds to the cathode side of the drive transistor M1 in the diode-connected state (case where an orientation of the diode virtually achieved by the drive transistor M1 in the diode-connected state is opposite to that in each of the embodiments described above by adopting another configuration in which, for example, an N-channel type transistor is used as the drive transistor M1 in the pixel circuit 11*x*), the reset voltage is only required to be the maximum voltage that the data signal line may have during the scanning select period or a voltage greater than the maximum voltage. In a more general sense, the reset voltage is only required to be a voltage that initializes each data signal line Dxi in order to be capable of charging the data-holding capacitor C1 via the drive transistor M1 in the diode-connected state in the pixel circuit 11*x* regardless of the voltage that the data signal line Dxi may have during the scanning select period. Therefore, the voltage that can be used as the initialization voltage Vini of the data-holding capacitor C1 can be used as the reset voltage.

Further, the SSD method with multiplicity of 3 is adopted in the first embodiment (FIG. 2), and the SSD method with multiplicity of 2 is adopted in the second embodiment (FIG. 8). However, the SSD method with multiplicity of 4 or more may be adopted. For example, in an organic EL display device displays a color image on the basis of four primary colors including R (red), G (green), B (blue), and W (white), the SSD method with multiplicity of 4 may be adopted in which a plurality of data signal lines in the display unit are divided into m data signal line groups, each of which is a set of four data signal lines corresponding to the four primary. In this case, m demultiplexers are provided correspondingly to the m data signal line groups. Each of the demultiplexers includes four selecting transistors as switching elements, which are respectively connected to the four data signal lines in the corresponding group, and the four data signals (four analog voltage signals corresponding to the four primary colors), which are output in time division from each output terminal Tdi of the data-side drive circuit 30, are applied to the four data signal lines by the demultiplexer 41. In a more general sense, the multiplicity of the SSD method is only required to be a predetermined number being two or more, which is sufficiently smaller than the number of data signal lines disposed in the display unit 10. In a case that the SSD method in which multiplicity is a predetermined number of two or more is adopted, the plurality of data signal lines in the display unit are divided into the m data signal line groups, each of the m data signal line groups including the predetermined numbers of data signal lines, and the m demultiplexers 41 are provided correspondingly to the m data signal line groups. In this case, each of the demultiplexer 41 includes the predetermined number of selecting transistors as switching elements, which are respectively connected to the predetermined number of data signal lines in the corresponding group, and the predetermined number of data signals (the predetermined number of analog voltage signals) output in time division from each output terminal Tdi of the data-side drive circuit 30 are applied to the predetermined number of data signal lines by the demultiplexer 41.

In each of the embodiments, to apply the predetermined number of data signals, which are output in time division from each output terminal Tdi of the data-side drive circuit 30, to the predetermined number of data signal lines by the demultiplexer 41, the predetermined number of selecting transistors in each of the demultiplexers 41 are alternatingly in the on state for the predetermined period after the terminal point of the reset period in the 1H period (see FIG. 4 and FIG. 10). The predetermined period (the period during which the selection control signal SSDx is at the low level after the terminal point of the reset period at the time t4) is the period during which each data line capacitance Cdxi (x=r, g, b or x=a, b) is charged with the voltage of the data signal, and it is preferred that the period be prolonged after the terminal point of the reset period at the time t4 in the 1H period within such a range that demultiplex by the demultiplexer 41 and charging (pixel charging) of the data-holding capacitor C1 in the pixel circuit 11*x* can be performed appropriately. Further, in each of the embodiments, the length of the on period corresponding to the predetermined period is uniformed among the predetermined number of selecting transistors Mx (x=r, g, b or x=a, b) in each demultiplexer. However, in consideration of, for example, a charging time, a capacitance value, or the like of the data-holding capacitor C1 in each pixel circuit 11*x*, the length of the predetermined period may differ among the predetermined number of selecting transistors Mx.

Further, in the first embodiment, as illustrated in FIG. 4, regarding the order in which the predetermined number of selecting transistors in each demultiplexer 41 turn to the on state for the predetermined period after the terminal point of the reset period in the 1H period, the R selecting transistor Mr, the G selecting transistor Mg, and the B selecting transistor Mb turn to the on state in the stated order. In the second embodiment, as illustrated in FIG. 10, the A selecting transistor Ma and the B selecting transistor Mb turn to the on state in the stated order. However, the disclosure is not limited thereto. For example, in a case that the predetermined number of (three or two) pixel circuits, which are respectively connected to the predetermined number of data signal lines corresponding to each demultiplexer 41 (the three pixel circuits 11*r*, 11*g*, and 11*b* in the first embodiment or the two pixel circuits 11*a* and 11*b* in the second embodiment) have different capacitance values of the data-holding capacitors C1, it is preferred that the order in accordance with the capacitance values thereof be set. Specifically, it is preferred that the order be set such that, among the predetermined number of selecting transistors (the three selecting transistors Mr, Mg, and Mb or the two selecting transistors Ma and Mb) included in each demultiplexer, the selecting transistor Mx, which has a small capacitance value of the data-holding capacitor C1 in the pixel circuit 11*x* corresponding to the connected data signal line Dxi (x=r, g, b or x=a, b), turns to the on state at a later timing. This holds true in the configuration in which the SSD method in which multiplicity is a predetermined number of 4 or more is adopted, the method in which the plurality pf data signals are divided into the m data signal line groups, each of which is a set of four data signal lines. With this configuration, the charging rate of the data-holding capacitor C1 in each of the pixel circuits can be improved efficiently.

Note that, in the description given above, the description is made on each of the embodiments and the modified examples by exemplifying the organic EL display device. However, the disclosure is not limited to the organic EL display device, and is applicable to any display device adopting the SSD method using a display element driven by a current. The display element that can be used here is a display element having luminance, transmittance, or the like that is controlled by a current. For example, an inorganic light emitting diode, a Quantum dot Light Emitting Diode (QLED), and the like can be used in addition to an organic EL element, that is, an Organic Light Emitting Diode (OLED).

4. Supplement

Supplement 1

A display device includes a plurality of data signal lines configured to transmit a plurality of analog voltage signals indicating an image to be displayed, a plurality of scanning signal lines intersecting the plurality of data signal lines, and a plurality of pixel circuits arranged in a matrix shape along the plurality of data signal lines and the plurality of scanning signal lines. The display device further includes a data-side drive circuit including a plurality of output terminals respectively corresponding to a plurality sets of data signal line groups that are obtained by dividing the plurality of data signal lines into groups, each of which is a set including a two or more predetermined number of data signal lines and configured to output, in time division from each of the plurality of output terminals, a predetermined number of analog voltage signals to be each transmitted by the predetermined number of data signal lines of a set corresponding to each of the plurality of output terminals, a plurality of demultiplexers respectively connected to the plurality of output terminals of the data-side drive circuit and respectively correspond to the plurality sets of data signal line groups, a scanning-side drive circuit configured to selectively drive the plurality of scanning signal lines, and a display control circuit configured to control the plurality of demultiplexers, the data-side drive circuit, and the scanning-side drive circuit. Each of the plurality of demultiplexers includes a predetermined number of switching elements corresponding to the predetermined number of data signal lines in a corresponding set, respectively, and each of the predetermined number of switching elements includes a first conduction terminal connected to a corresponding data signal line, a second conduction terminal configured to receive an analog voltage signal output by the data-side drive circuit from an output terminal of the plurality of output terminals connected to a demultiplexer of the plurality of demultiplexers, and a control terminal configured to receive a selection control signal for controlling on and off states. Each of the plurality of pixel circuits corresponds to any one of the plurality of data signal lines and corresponds to any one of the plurality of scanning signal lines. Each of the plurality of pixel circuits includes a display element configured to be driven by a current, a holding capacitance configured to hold a voltage for controlling a drive current for the display element, and a drive transistor configured to supply, to the display element, the drive current in accordance with the voltage held in the holding capacitance and is configured such that in a case that a corresponding scanning signal line is in a select state, the drive transistor is in a diode-connected state, and a voltage of a corresponding data signal line is supplied to the holding capacitance via the drive transistor. The display control circuit turns one or more switching elements to an on state among the predetermined number of switching elements in each of the plurality of demultiplexers during a reset period provided, for a scanning signal line of the plurality of scanning signal lines, after a preceding scanning signal line is changed to a non-select state and before the scanning signal line is selected, the preceding scanning signal line being another scanning signal line of the plurality of scanning signal lines selected immediately before the scanning signal line is selected, and sequentially turns the predetermined number of switching elements to the on state for a predetermined period after the reset period and before the scanning signal line is changed from the select state to the non-select state such that at least one switching element of the one or more switching elements turns to the on state during a select period for each of the plurality of scanning signal lines. The data-side drive circuit, during the reset period, outputs a voltage for initializing each of the plurality of data signal lines as a reset voltage from each of the plurality of output terminals, and, after the reset period, outputs the predetermined number of analog voltage signals in time division from each of the plurality of output terminals in accordance with control of the display control circuit that sequentially turns the predetermined number of switching elements to the on state for the predetermined period.

Supplement 2

In the display device described in Supplement 1, for a scanning signal line of the plurality of scanning signal lines, the display control circuit may be configured to sequentially turn the predetermined number of switching elements to the on state for the predetermined period after the reset period and before the scanning signal line is changed from the select state to the non-select state such that at least one switching element, which is different from the at least one switching element among the predetermined number of switching elements, is in the on state after the reset period and before the scanning signal line is changed to the select state.

Also in the display device described in Supplement 2, for each scanning signal line, the predetermined number of switching elements in each demultiplexer sequentially turn to the on state for the predetermined period after the reset period and before the scanning signal line is changed from the select state to the non-select state. In this case, among the predetermined number of switching elements, at least one switching element, which is different from the switching element in the on state during the select period for the scanning signal line, turns to the on state after the reset period and before the select period. The display device described in Supplement 2 can exert the similar effects on the basis of the similar characteristics of the display device described in Supplement 1.

Supplement 3

In the display device described in Supplement 1, the display control circuit may be configured to sequentially turn the predetermined number of switching elements to the on state for the predetermined period after the reset period and before a scanning signal line of the plurality of scanning signal lines is changed from the select state to the non-select state such that only one switching element among the one or more switching elements is in the on state during a select period for each of the plurality of scanning signal lines.

Also in the display device described in Supplement 3, for each scanning signal line, the predetermined number of switching elements in each demultiplexer sequentially turn to the on state for the predetermined period after the reset period and before the scanning signal line is changed from the select state to the non-select state. In this case, in each demultiplexer, only one switching element of the one or more switching elements in the on state during the reset period turns to the on state in the select period for each scanning signal line. In each demultiplexer, the other switching elements turn to the on state for the predetermined period before the select period for the scanning signal line, and the data signal lines connected to the other switching elements are charged with the analog voltage signals as the corresponding data signals. Therefore, according to the display device described in Supplement 3, as compared to the case where two or more switching elements in each demultiplexer turn to the on state during the select period for each scanning line, a difference in charging rate of the holding capacitance is less likely to occur among the pixel circuits. As a result, generation of luminance variation due to a difference in charging rate can be suppressed, and display quality can be improved.

Supplement 4

In the display device described in Supplement 3, the display control circuit may be configured to turn only the one switching element to the on state during the reset period.

In the display device described in Supplement 4, only one switching element among the predetermined number of switching elements in each demultiplexer turns to the on state during the rest period. After the rest period, the other switching elements in each demultiplexer turn to the on state for the predetermined period before the select period for each scanning signal line, and the one switching element turns to the on state during the select period. Therefore, according to the display device described in Supplement 4, in addition to the similar effects of the display device described in Supplement 3, the number of data signal lines to be initialized by supplying the rest voltage is reduced, and hence power required for initializing the data signal lines can be reduced.

Supplement 5

In the display device described in Supplement 1 or 2, the plurality of data signal lines may be configured to transmit a plurality of analog voltage signals indicating a color image based on three or more predetermined number of primary colors, each of the plurality of data signal lines may be correspond to any one of the three or more predetermined number of primary colors, the plurality sets of data signal groups may be obtained by dividing the plurality of data signal lines into groups, each of which is a set including a predetermined number of data signal lines corresponding to the three or more predetermined number of primary colors, and the plurality of pixel circuits may be configured to display the color image on the basis of the plurality of analog voltage signals.

According to the display device described in Supplement 5, the plurality of data signal lines in the display unit transmit the plurality of analog voltage signals indicating the color image based on the three or more predetermined number of primary colors, and are divided into the plurality sets of data signal line groups, each of which is a set including the predetermined number of data signal lines corresponding to the predetermined number of primary colors. The analog voltage signals, which are output in time division from each output terminal of the data-side drive circuit, are sequentially supplied to the predetermined number of data signal lines in the set corresponding to the output terminal. In the display device configured to display a color image with the SSD method, the similar effects can be obtained on the basis of the similar characteristics of the display device described in Supplement 1 or 2.

Supplement 6

In the display device described in Supplement 1 or 2, the display control circuit may be configured to sequentially turn the predetermined number of switching elements to the on state for the predetermined period after the reset period such that, among the predetermined number of switching elements, a switching element to which a pixel circuit corresponding to a data signal line connected has a small value of a holding capacitance turns to the on state in a later timing.

According to the display device described in Supplement 6, the charging rate of the holding capacitance in each of the pixel circuits can be improved efficiently.

Supplement 7

In the display device described in any one of Supplements 1 to 6, the plurality of pixel circuits may each be configured such that a data signal line corresponding to a pixel circuit of the plurality of pixel circuits corresponds to an anode side of a drive transistor in the diode-connected state in the pixel circuit, and, in a case that any of the plurality of scanning signal lines is in the select state, the data-side drive circuit may be configured to output, from each of the plurality of output terminals, an allowable minimum voltage of each of the plurality of data signal lines or a voltage less than the allowable minimum voltage as a reset voltage during the reset period.

According to the display device described in Supplement 7, the plurality of pixel circuits may be each configured such that a data signal line corresponding to a pixel circuit of the plurality of pixel circuits corresponds to an anode side of the drive transistor in the diode-connected state in the pixel circuit, and, in a case that any of the plurality of scanning signal lines in the display unit is in the select state, the allowable minimum voltage of each of the plurality of data signal lines or the voltage less than the minimum voltage is supplied as the reset voltage to the data signal line during the reset period. With this, the data signal line is initialized. With this, even in a case that the period during which the data signal line initialized by the reset voltage is charged with the analog voltage signal as the data signal and the period during which the holding capacitance in the pixel circuit is charged with the voltage of the data signal line (scanning select period) overlap with each other, the data writing failure caused by the diode-connection in the pixel circuit does not occur. Therefore, the charging period of the data signal line initialized by the reset voltage and the charging period of the holding capacitance in the pixel circuit (scanning select period) can overlap with each other. With this, while avoiding the data writing failure, the charging period of each data signal line and the charging period of the holding capacitance in each pixel circuit can be increased.

Supplement 8

In the display device described in any one of Supplements 1 to 6, the plurality of pixel circuits may be each configured such that a data signal line corresponding to a pixel circuit of the plurality of pixel circuits corresponds to a cathode side of the drive transistor in the diode-connected state in the pixel circuit, and in a case that any of the plurality of scanning signal lines is in the select state, the data-side drive circuit may be configured to output, from each of the plurality of output terminals, an allowable maximum voltage of each of the plurality of data signal lines or a voltage greater than the allowable maximum voltage as a reset voltage during the reset period.

According to the display device described in Supplement 8, the plurality of pixel circuits are each configured such that a data signal line corresponding to a pixel circuit of the plurality of pixel circuits corresponds to the cathode side of the drive transistor in the diode-connected state in the pixel circuit, and in a case that any of the plurality of scanning signal lines in the display unit is in the select state, the allowable maximum voltage of each of the plurality of data signal lines or the voltage greater than the allowable maximum voltage is supplied as the reset voltage to each of the plurality of data signal lines during the reset period. With this, the data signal line is initialized. With this, even in a case that the period during which the data signal line initialized by the reset voltage is charged with the analog voltage signal as the data signal and the period during which the holding capacitance in the pixel circuit is charged with the voltage of the data signal line (scanning select period) overlap with each other, the data writing failure caused by the diode-connection in the pixel circuit does not occur. Therefore, the charging period of the data signal line initialized by the reset voltage and the charging period of the holding capacitance in the pixel circuit (scanning select period) can overlap with each other. With this, while avoiding the data writing failure, the charging period of each data signal line and the charging period of the holding capacitance in each pixel circuit can be increased.

REFERENCE SIGNS LIST

1, 2 Display device
10 Display unit
11, 11*x* Pixel circuit (x=r, g, b, or x=a, b)
20 Display control circuit
30 Data-side drive circuit
40 Demultiplexer unit
41 Demultiplexer
50 Scanning-side drive circuit
60 Light emission control line drive circuit
Tdi Output terminal (i=1 to m)
Di Output line (i=1 to m)
Dri, Dgi, Dbi Data signal line
Dai, Dbi Data signal line
Sj Scanning signal line (j=1 to n)
Ej Light emission control line (j=1 to n)
Cdri, Cdgi, Cdbi Data line capacitance (i=1 to m)
Cdai, Cdbi Data line capacitance (i=1 to m)
Mr, Mg, Mb Selecting transistor (switching element)
Ma, Mb Selecting transistor (switching element)
M1 Drive transistor
M2 Writing transistor
M3 Compensating transistor
M4, M7 Initialization transistor
M5 Power-supplying transistor
M6 Light emission control transistor
C1 Data-holding capacitor (holding capacitance)
SSDx Selection control signal (x=r, g, b or x=a, b)

The invention claimed is:

1. A display device comprising:

a plurality of data signal lines configured to transmit a plurality of analog voltage signals indicating an image to be displayed;

a plurality of scanning signal lines intersecting the plurality of data signal lines; and a plurality of pixel circuits arranged in a matrix along the plurality of data signal lines and the plurality of scanning signal lines, wherein the display device further includes:

a data-side drive circuit including a plurality of output terminals respectively corresponding to a plurality sets of data signal line groups that are obtained by dividing the plurality of data signal lines into groups, each of which is a set including a two or more predetermined number of data signal lines and configured to output, in time division from each of the plurality of output terminals, a predetermined number of analog voltage signals to be each transmitted by the predetermined number of data signal lines of a set corresponding to each of the plurality of output terminals, a plurality of demultiplexers respectively connected to the plurality of output terminals of the data-side drive circuit and respectively correspond to the plurality sets of data signal line groups, a scanning-side drive circuit configured to selectively drive the plurality of scanning signal lines, and a display control circuit configured to control the plurality of demultiplexers, the data-side drive circuit, and the scanning-side drive circuit, each of the plurality of demultiplexers includes a predetermined number of switching elements respectively corresponding to the predetermined number of data signal lines in a corresponding set, respectively, and each of the predetermined number of switching elements includes a first conduction terminal connected to a corresponding data signal line, a second conduction terminal configured to receive an analog voltage signal output by the data-side drive circuit from an output terminal of the plurality of output terminals connected to a demultiplexer of the plurality of demultiplexers, and a control terminal configured to receive a selection control signal for controlling on and off states, each of the plurality of pixel circuits corresponds to any one of the plurality of data signal lines and corresponds to any one of the plurality of scanning signal lines, each of the plurality of pixel circuits includes a display element configured to be driven by a current, a holding capacitance configured to hold a voltage for controlling a drive current for the display element, and a drive transistor configured to supply, to the display element, the drive current in accordance with the voltage held in the holding capacitance and is configured such that in a case that a corresponding scanning signal line is in a select state, the drive transistor is in a diode-connected state, and a voltage of a corresponding data signal line is supplied to the holding capacitance via the drive transistor, the display control circuit:

turns only one switching element to an on state among the predetermined number of switching elements in each of the plurality of demultiplexers during a reset period provided, for a scanning signal line of the plurality of scanning signal lines, after a preceding scanning signal line is changed to a non-select state and before the scanning signal line is selected, the preceding scanning signal line being another scanning signal line of the plurality of scanning signal lines selected immediately before the scanning signal line is selected, and sequentially turns the predetermined number of switching elements to the on state for a predetermined period after the reset period and before the scanning signal line is changed from the select state to the non-select state such that the only one switching element turns to the on state during a select period for each of the plurality of scanning signal lines and such that among the predetermined number of switching elements any switching element except the only one switching element is in the on state after the reset period and before the scanning signal line is changed to the select state, and the data-side drive circuit:

during the reset period, outputs a voltage for initializing each of the plurality of data signal lines as a reset voltage from each of the plurality of output terminals, and after the reset period, outputs the predetermined number of analog voltage signals in time division from each of the plurality of output terminals in accordance with control of the display control circuit that sequentially turns the predetermined number of switching elements to the on state for the predetermined period.

2. The display device according to claim 1, wherein the plurality of data signal lines are configured to transmit a plurality of analog voltage signals indicating a color image based on three or more predetermined number of primary colors, and each of the plurality of data signal lines corresponds to any one of the three or more predetermined number of primary colors, the plurality sets of data signal groups are obtained by dividing the plurality of data signal lines into groups, each of which is a set including a predetermined number of data signal lines corresponding to the three or more predetermined number of primary colors, and the plurality of pixel circuits are configured to display the color image on the basis of the plurality of analog voltage signals.

3. The display device according to claim 1, wherein the display control circuit is configured to sequentially turn the predetermined number of switching elements to the on state for the predetermined period after the reset period such that, among the predetermined number of switching elements, a switching element to which a pixel circuit corresponding to a data signal line connected has a small value of a holding capacitance turns to the on state in a later timing.

4. The display device according to claim 1, wherein the plurality of pixel circuits are each configured such that a data signal line corresponding to a pixel circuit of the plurality of pixel circuits corresponds to an anode side of a drive transistor in the diode-connected state in the pixel circuit, and, in a case that any of the plurality of scanning signal lines is in the select state, the data-side drive circuit is configured to output, from each of the plurality of output terminals, an allowable minimum voltage of each of the plurality of data signal lines or a voltage less than the allowable minimum voltage as a reset voltage during the reset period.

5. The display device according to claim 1, wherein the plurality of pixel circuits are each configured such that a data signal line corresponding to a pixel circuit of the plurality of pixel circuits corresponds to a cathode side of the drive transistor in the diode-connected state in the pixel circuit, and in a case that any of the plurality of scanning signal lines is in the select state, the data-side drive circuit is configured to output, from each of the plurality of output terminals, an allowable maximum voltage of each of the plurality of data signal lines or a voltage greater than the allowable maximum voltage as a reset voltage during the reset period.

6. A driving method of a display device, the display device including:

a plurality of data signal lines configured to transmit a plurality of analog voltage signals indicating an image to be displayed, a plurality of scanning signal lines intersecting the plurality of data signal lines, a plurality of pixel circuits arranged in a matrix along the plurality of data signal lines and the plurality of scanning signal lines, a data-side drive circuit including a plurality of output terminals respectively corresponding to a plurality sets of data signal line groups that are obtained by dividing the plurality of data signal lines into groups, each of which is a set including a two or more predetermined number of data signal lines, and a plurality of demultiplexers respectively connected to the plurality of output terminals of the data-side drive circuit and corresponding to the plurality sets of data signal line groups, respectively, wherein each of the plurality of demultiplexers including a predetermined number of switching elements corresponding to the predetermined number of data signal lines in a corresponding set, respectively, each of the predetermined number of switching elements including a first conduction terminal connected to a corresponding data signal line, a second conduction terminal configured to receive an analog voltage signal output by the data-side drive circuit from an output terminal of the plurality of output terminals connected to a demultiplexer of the plurality of demultiplexers, and a control terminal configured to receive a selection control signal for controlling on and off states, each of the plurality of pixel circuits corresponding to any one of the plurality of data signal lines and corresponding to any one of the plurality of scanning signal lines, and each of the plurality of pixel circuits including a display element configured to be driven by a current, a holding capacitance configured to hold a voltage for controlling a drive current for the display element, and a drive transistor configured to supply, to the display element, the drive current in accordance with the voltage held in the holding capacitance and being configured such that in a case that a corresponding scanning signal line is in a select state, the drive transistor is in a diode-connected state, and a voltage is supplied from a corresponding data signal line to the holding capacitance via the drive transistor, the method comprising:

a scanning-side driving step of selectively driving the plurality of scanning signal lines;

a reset step of turning only one switching element to an on state among the predetermined number of switching elements in each of the plurality of demultiplexers during a reset period provided, for a scanning signal line of the plurality of scanning signal lines, after a preceding scanning signal line is changed to a non-select state and before the scanning signal line is selected, the preceding scanning signal line being another scanning signal line of the plurality of scanning signal lines selected immediately before the scanning signal line is selected;

a demultiplex step of sequentially turning the predetermined number of switching elements to the on state for a predetermined period after the reset period and before the scanning signal line is changed from the select state to the non-select state such that the only one switching element turns to the on state during a select period for each of the plurality of scanning signal lines and such that among the predetermined number of switching elements any switching element except the only one switching element is in the on state after the reset period and before the scanning signal line is changed to the select state;

a reset voltage output step of outputting a voltage for initializing each of the plurality of data signal lines as a reset voltage from each of the plurality of output terminals of the data-side driver circuit during the reset period; and a data signal output step of outputting, in time division from each of the plurality of output terminals of the data-side drive circuit, the predetermined number of analog voltage signals to be each transmitted to the predetermined number of data signal lines in the set corresponding to each of the plurality of output terminals after the reset period, in accordance with the demultiplex step of sequentially turning the predetermined number of switching elements to the on state for the predetermined period.

* * * * *